US007539428B2

(12) United States Patent
Yamada

(10) Patent No.: US 7,539,428 B2
(45) Date of Patent: May 26, 2009

(54) IMAGE-FORMING DEVICE WHEREIN THE DENSITY OF THE IMAGES ARE CORRECTED

(75) Inventor: Akihiro Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 393 days.

(21) Appl. No.: 11/043,049

(22) Filed: Jan. 27, 2005

(65) Prior Publication Data

US 2005/0169651 A1 Aug. 4, 2005

(30) Foreign Application Priority Data

Jan. 30, 2004 (JP) ..... 2004-024908

(51) Int. Cl.
*G03G 15/00* (2006.01)

(52) U.S. Cl. ..... 399/49

(58) Field of Classification Search ..... 399/49
See application file for complete search history.

(56) References Cited

U.S. PATENT DOCUMENTS

| | | | | |
|---|---|---|---|---|
| 5,887,223 | A * | 3/1999 | Sakai et al. | 399/60 |
| 6,147,698 | A * | 11/2000 | Zable et al. | 347/240 |
| 6,337,958 | B1 * | 1/2002 | Stanich et al. | 399/49 |
| 7,062,185 | B2 * | 6/2006 | Izumikawa et al. | 399/49 |
| 2002/0051648 | A1 * | 5/2002 | Shimomura et al. | 399/49 |
| 2004/0096231 | A1 * | 5/2004 | Furno et al. | 399/49 |
| 2004/0131371 | A1 * | 7/2004 | Itagaki et al. | 399/49 |
| 2004/0136738 | A1 * | 7/2004 | Yamamoto et al. | 399/49 |
| 2004/0240902 | A1 * | 12/2004 | Dalal et al. | 399/49 |
| 2005/0157317 | A1 * | 7/2005 | Butterfield et al. | 358/1.9 |

FOREIGN PATENT DOCUMENTS

| | | | |
|---|---|---|---|
| JP | A-03-193380 | | 8/1991 |
| JP | 05-122513 | | 5/1993 |
| JP | A-07-162577 | | 6/1995 |
| JP | A-08-240943 | | 9/1996 |
| JP | 10-272806 | | 10/1998 |
| JP | 2001-26170 | | 1/2001 |
| JP | 2001-213036 | | 8/2001 |
| JP | A-2001-328327 | | 11/2001 |
| JP | 2002-072771 | * | 3/2002 |
| JP | 2002-252780 | | 9/2002 |

* cited by examiner

*Primary Examiner*—Timothy J Dole
*Assistant Examiner*—Jeff Natalini
(74) *Attorney, Agent, or Firm*—Oliff & Berridge, PLC

(57) ABSTRACT

A printer is capable of generating a plurality of different measurement patch groups, each group being configured of a plurality of measurement patches having different densities. The printer determines the overall density level of the image by examining image data. Based on the determined overall density level of the image, the printer determines patch densities for the measurement patches so that the patch densities become darker as the overall density level of the image becomes darker and become lighter as the overall density level of the image becomes lighter. When the measurement patches are generated based on the determined patch densities, a density sensor is controlled to measure the densities in the measurement patches. A correction table is created based on the measured results. The printer corrects densities in the image data based on the correction table, and prints the image on a paper based on the corrected image data.

28 Claims, 15 Drawing Sheets

FIG.5(a)

PIXEL DATA P

| | |
|---|---|
| C | 45 |
| M | 60 |
| Y | 50 |
| K | 125 |

FIG.5(b)

T3

TONER COLOR C

| DENSITY RANGE | PERCENTAGE (%) |
|---|---|
| I (0~63) | 10 |
| II (64~127) | 15 |
| III (128~191) | 50 |
| IV (192~255) | 25 |

FIG.6(a)

T1

| | |
|---|---|
| A | 0~63 |
| B | 64~127 |
| C | 128~191 |
| D | 192~255 |
| E | EVENLY DISTRIBUTED |
| F | DEFAULT |

FIG.6(b)

T2

| DENSITY (%) | A | B | C | D | E | F |
|---|---|---|---|---|---|---|
| 10% | 25 | 45 | 60 | 5 | 20 | |
| 15% | 30 | 50 | 65 | 25 | 30 | |
| 20% | 40 | 55 | 70 | 55 | 40 | |
| 25% | 45 | 60 | 75 | 75 | 50 | |
| 30% | 50 | 65 | 80 | 95 | 60 | |

FIG.10(a)

T4

| PAPER DENSITY | ADD (%) |
|---|---|
| 0~31 | 0 |
| 32~63 | 5 |
| 64~95 | 10 |
| 96~127 | 15 |
| 128~159 | 20 |
| ⋮ | ⋮ |

FIG.10(b)

| DENSITY (%) ↓ | A | B | C | D | E | F |
|---|---|---|---|---|---|---|
| | 15% | 30 | 50 | 65 | 10 | 25 |
| | 20% | 35 | 55 | 70 | 30 | 35 |
| | 25% | 45 | 60 | 75 | 60 | 45 |
| | 30% | 50 | 65 | 80 | 80 | 55 |
| | 35% | 55 | 70 | 85 | 100 | 65 |

IMAGE-FORMING DEVICE WHEREIN THE DENSITY OF THE IMAGES ARE CORRECTED

BACKGROUND OF THE INVENTION

1. Field of the Invention

The present invention relates to an image-forming device.

2. Description of Related Art

An image-forming device such as that disclosed in Japanese unexamined patent application publication No. 2002-252780 employs a correction process to correct color values. This type of image-forming device creates a pattern having density gradations, reads the pattern, and corrects print data (image data read from the host program).

More specifically, the image-forming device prints a density pattern in a prescribed region on a paper, the density pattern including a group of measurement patches or marks having different densities, and measures the density pattern with a sensor. Based on the measured values, the image-forming device creates correction data and stores this data in a storage unit. Subsequently, when performing actual printing operations, the image-forming device converts tone data in the print data (image data) to corrected tone data suitable for the printer based on the correction data stored in the storage unit. By providing these converted tone data to the printer, the image-forming device can avoid large differences between the densities on the printed material and the density information included in the print data (tone data).

The image-forming device disclosed in the above-described publication includes a plurality of paper cassettes and a storage area for storing color correction data corresponding to each paper cassette. The image-forming device forms a predetermined density pattern (a plurality of marks having different densities) on paper supplied from each paper cassette and calculates color correction data for each paper cassette by reading the printed density pattern. This calculated color correction data is then stored in a storage area corresponding to each paper cassette as data unique to that paper cassette. When each paper cassette is loaded with a different color of paper, the image-forming device can perform a print operation using color correction data that corresponds to the specific color of paper. In other words, the image-forming device can perform color correction that reflects the color of paper being used in order to improve the accuracy of image formation.

SUMMARY OF THE INVENTION

It is an object of the present invention to provide an improved image-forming device that is capable of performing a more accurate printing process.

In order to attain the above and other objects, the present invention provides an image-forming device, including: a printing unit: a patch generating unit; an image-density characteristics determining unit; a density measuring unit; a correcting unit; and a print controlling unit. The printing unit prints images on a recording medium. The patch generating unit is capable of generating a plurality of measurement patches. The plurality of measurement patches have different densities. The image-density characteristics determining unit determines image-density characteristics of an image desired to be printed on the recording medium by the printing unit, and sets densities of the measurement patches to be generated by the patch generating unit based on the determined image-density characteristics of the desired image. The density measuring unit measures the densities of the measurement patches generated by the patch generating unit. The correcting unit performs density correction of the desired image according to densities of the measurement patches measured by the density measuring unit. The print controlling unit controls the printing unit to print the desired image on the recording medium based on results of density correction by the correcting unit.

According to another aspect, the present invention provides an image-forming device, including: a printing unit; a medium-density acquiring unit; an adjusting unit; a patch generating unit; a patch density setting unit; a density measuring unit; a correcting unit; and a print controlling unit. The printing unit prints images on a recording medium. The medium-density acquiring unit acquires medium-density data indicative of density of the recording medium. The adjusting unit adjusts density of images based on the medium-density data. The patch generating unit is capable of generating a plurality of measurement patches having different densities. The patch density setting unit sets densities of the measurement patches to be generated by the patch generating unit based on the medium-density data. The density measuring unit measures the densities of the measurement patches generated by the patch generating unit. The correcting unit performs density correction of an image desired to be printed on the recording medium according to densities of the measurement patches measured by the density measuring-unit. The print controlling unit controls the printing unit to print the desired image on the recording medium based on results of density correction by the correcting unit.

According to another aspect, the present invention provides an image-forming device, including: a printing unit; a patch generating unit; an input unit; a patch density setting unit; a density measuring unit; a correcting unit; and a print controlling unit. The printing unit prints images on a recording medium. The patch generating unit is capable of generating a plurality of measurement patches having different densities. The input unit enables a user to input settings data. The patch density setting unit sets densities of the measurement patches to be generated by the patch generating unit based on the inputted settings data. The density measuring unit measures the densities of the measurement patches generated by the patch generating unit. The correcting unit performs density correction of an image desired to be printed on the recording medium according to densities of the measurement patches measured by the density measuring unit. The print controlling unit controls the printing unit to print the desired image on the recording medium based on results of density correction by the correcting unit.

According to another aspect, the present invention provides an image-forming device, including: a printing unit; an image-data receiving unit; a patch density determining unit; a patch generating unit; a density measuring unit; a correction data generating unit; a correction-data-dependent image-data correcting unit; and a print controlling unit. The printing unit is capable of printing images on a recording medium. The image-data receiving unit receives image data indicative of density of an image desired to be formed on the recording medium. The patch density determining unit determines one patch density group dependently on at least one of the image data and density of the recording medium. The one patch density group includes several patch densities. The patch generating unit controls the printing unit to generate a group of measurement patches based on the determined patch density group. The group of measurement patches includes several measurement patches. The several measurement patches are generated based on the several patch densities included in the determined patch density group. The density measuring unit measures densities of the several measurement patches generated by the patch generating unit. The correction data generating unit generates correction data based on the measured densities. The correction-data-dependent image-data correcting unit corrects the image data based on the correction data. The print controlling unit controls the printing unit to print the desired image on the recording medium based on the image data corrected by the correction-data-dependent image-data correcting unit.

BRIEF DESCRIPTION OF THE DRAWINGS

In the drawings:

FIG. 3(*b*) is a flowchart illustrating steps in a patch data selecting process in the printing process of FIG. 3(*a*);

FIG. 4(*b*) illustrates a graph showing how to create the correction table of FIG. 4(*a*) in a patch-creating-and-table-creating step of FIG. 3(*a*);

FIG. 5(*a*) is an explanatory diagram showing an example of a set of pixel data for one pixel P;

FIG. 5(*b*) is an explanatory diagram showing an example of a density-distribution table, which is prepared during an image-data-density characteristics examining process in FIG. 3(*b*);

FIG. 6(*a*) is an explanatory diagram showing an example of a patch-to-image-density table indicative of a one-to-one correspondence between several patch density groups and several possible density-distribution-states of images;

FIG. 6(*b*) is an explanatory diagram showing an example of a patch-density-group table indicating the several different groups of patch densities;

FIG. 9(*b*) is a flowchart illustrating steps in an image density adjusting process in the printing process of FIG. 9(*a*);

FIG. 9(*c*) is a flowchart illustrating steps in a patch data selecting process in the printing process of FIG. 9(*a*);

FIG. 10(*a*) is an explanatory diagram showing an example of a paper-to-rate table indicating a one-to-one correspondence between several possible paper densities and several adjustment rates for patch densities;

FIG. 10(*b*) is an explanatory diagram illustrating how the patch densities in the patch-density-group table of FIG. 6(*b*) are added with an adjustment rate of five percents according to a method of the second embodiment;

DETAILED DESCRIPTION OF THE PREFERRED EMBODIMENTS

Figure 1:
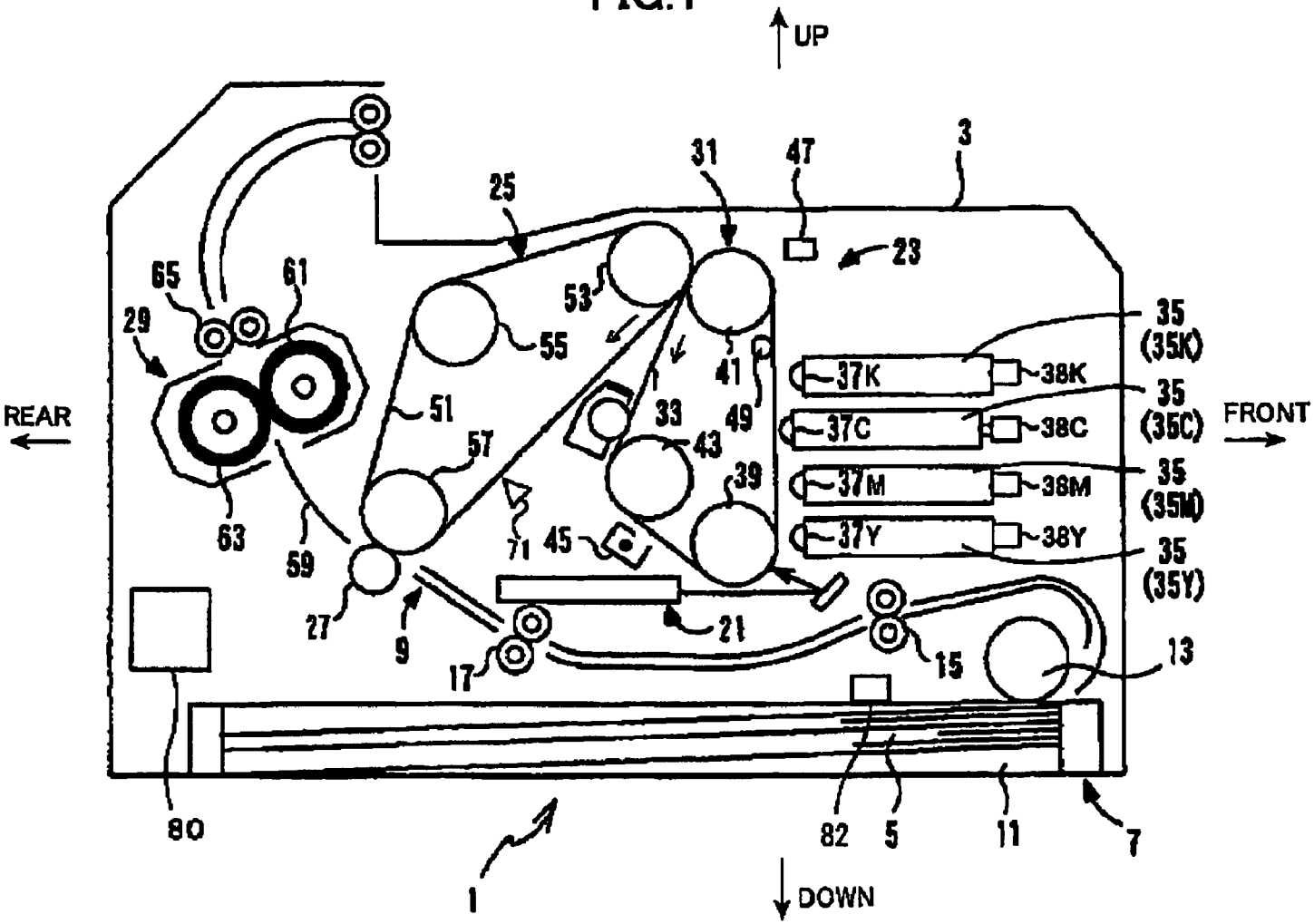
FIG. 1 is a cross-sectional view showing the general structure of a four-cycle color laser printer according to a first embodiment of the present invention.

An image-forming device according to preferred embodiments of the present invention will be described while referring to the accompanying drawings wherein like parts and components are designated by the same reference numerals to avoid duplicating description.

In the following description, the expressions "front", "rear", "upper", "lower", "right", and "left" are used to define the various parts when the image-forming device is disposed in an orientation in which it is intended to be used.

First Embodiment

A four-cycle color laser printer 1 according to a first embodiment of the present invention will be described below with reference to FIG. 1 to FIG. 7.

As shown in FIG. 1, the color laser printer 1 has a main case 3 inside of which are a paper supply unit 7 for supplying paper 5, and an image forming unit 9 for forming a desired image on the supplied paper 5.

The paper supply unit 7 includes a paper tray 11 for storing a stack of paper 5, a supply roller 13 that contacts the top sheet of paper 5 in the paper tray 11 and rotates to supply one sheet at a time to the image forming unit 9, and transportation rollers 15 and registration rollers 17 for conveying the paper 5 to an image formation position. The image formation position is a transfer position where a toner image on an intermediate transfer belt 51 (which will be described later) is transferred to the paper 5. The intermediate transfer belt 51 contacts a transfer roller 27 at the image formation position.

The image forming unit 9 includes a scanner unit 21, a processing unit 23, an intermediate transfer belt assembly 25, the transfer roller 27, and a fixing unit 29. The image forming unit 9 is used for printing desired images on papers 5 and for generating measurement patches on the intermediate transfer belt 51 as will be described later.

The scanner unit 21 is located in the center portion of the main case 3, and has: a laser unit, a polygon mirror, and a plurality of lenses and reflection mirrors (not shown). In the scanner unit 21, laser beam is emitted from the laser unit based on image data. The laser beam reflects off the polygon mirror and reflection mirrors, and passes through lenses to scan at a high speed the surface of an organic photoconductor (OPC) belt 33 in a belt photoconductor assembly 31 in the processing unit 23.

The processing unit 23 includes: the belt photoconductor assembly 31 and a plurality of (four) developer cartridges 35. The four developer cartridges 35, that is, the yellow developer cartridge 35Y holding yellow toner, the magenta developer cartridge 35M holding magenta toner, the cyan developer cartridge 35C holding cyan toner, and the black developer cartridge 35K holding black toner, are disposed inside the main case 3 at its front portion, and are arranged sequentially in series from bottom to top with a specific vertical gap between the adjacent cartridges.

Each of the developer cartridges 35 includes a developer roller 37 (yellow developer roller 37Y, magenta developer roller 37M, cyan developer roller 37C, and black developer roller 37K), a toner-layer thickness regulation blade, a supply roller, and a toner compartment (not shown). The developer cartridges 35 are moved horizontally to contact with and separate from the surface of the OPC belt 33 by means of respective separation solenoids 38 (yellow separation solenoid 38Y, magenta separation solenoid 38M, cyan separation solenoid 38C, and black separation solenoid 38K).

Each developer roller 37 has a metal roller shaft covered with a roller made from an elastic material, specifically a conductive rubber material. More specifically, the roller part of each developer roller 37 has a two-layer configuration including: an elastic roller part which is made from a conductive urethane rubber, silicone rubber, or EPDM rubber and which contains carbon powder; and a coating layer, which is made mainly of urethane rubber, urethane resin, or polyimide resin. During development, a specific developer bias is applied to the developer roller 37 relative to the OPC belt 33, and a specific recovery bias is applied during toner recovery. The specific developer bias is +300 V, and the specific recovery bias is −200 V, for example.

A spherical, nonmagnetic single component polymer toner of a positively charging nature is stored in the toner compartment of each developer cartridge 35 as the developer of the respective color (yellow, magenta, cyan, black). During development, the toner is supplied by rotation of the supply roller to the developer roller 37, and is positively charged by friction between the supply roller and developer roller 37. The toner supplied to the developer roller 37 is carried by rotation of the developer roller 37 between the toner-layer thickness regulation blade and the developer roller 37, is further sufficiently triboelectrically charged therebetween, and is thus held on the developer roller 37 as a thin layer of a uniform thickness. A reverse bias is applied to the developer roller 37 during toner recovery to recover the toner from the OPC belt 33 back to the toner compartment.

The belt photoconductor assembly 31 includes: a first OPC belt roller 39; a second OPC belt roller 41; a third OPC belt roller 43; the OPC belt 33 wound around the first to third OPC belt rollers 39-43; an OPC belt charger 45; a potential (voltage) applying unit 47; and a potential (voltage) gradient controller 49.

The intermediate transfer belt assembly 25 is disposed behind the belt photoconductor assembly 31, and includes: a first ITB roller 53; a second ITB roller 55; a third ITB roller 57; and the intermediate transfer belt 51 wound around the outside of the first to third ITB rollers 53 to 57. The first ITB roller 53 is located substantially opposite the second OPC belt roller 41 with the OPC belt 33 and intermediate transfer belt 51 therebetween. The second ITB roller 55 is located diagonally lower than and behind the first ITB roller 53. The third ITB roller 57 is located behind the second ITB roller 55 and opposite the transfer roller 27 with the intermediate transfer belt 51 therebetween.

The intermediate transfer belt 51 is an endless belt made from a conductive polycarbonate or polyimide resin, for example, containing a dispersion of conductive powder such as carbon.

The first ITB roller 53, second ITB roller 55, and third ITB roller 57 are arranged in a triangle around which the intermediate transfer belt 51 is wrapped. When the first ITB roller 53 is rotationally driven via drive gears (not shown) by a main motor (not shown), the second ITB roller 55 and third ITB roller 57 follow, and the intermediate transfer belt 51 moves circularly clockwise around the first to third ITB rollers 53 to 57.

A density sensor 71 is provided for detecting density of measurement patches formed on the intermediate transfer belt 51. The density sensor 71 includes a light source for emitting light in the infrared region, a lens for directing the emitted light to the intermediate transfer belt 51, and a phototransistor for detecting the light reflected from the intermediate transfer belt 51.

The transfer roller 27 is rotationally supported at a location opposite the third ITB roller 57 with the intermediate transfer belt 51 therebetween, and includes a conductive rubber roller covering a metal roller shaft. The transfer roller 27 is movable by a transfer roller separation mechanism (not shown) between a standby position where the transfer roller 27 is separated from the intermediate transfer belt 51, and a transfer position where the transfer roller 27 contacts the intermediate transfer belt 51. The transfer roller separation mechanism is disposed on both sides of the paper 5 transportation path 59 in the widthwise direction of the paper 5. When the transfer roller 27 is set to the transfer position, the transfer roller 27 presses the paper 5, which is being conveyed through the transportation path 59, against the intermediate transfer belt 51.

The transfer roller 27 is set to the standby position while visible images of the respective colors are being sequentially transferred to the intermediate transfer belt 51, and is set to the transfer position when all of the four toner images have been transferred from the OPC belt 33 to the intermediate transfer belt 51 to form a full-color image on the intermediate transfer belt 51. The transfer roller 27 is also set to the standby position during a calibration process described later.

When in the transfer position, a transfer bias application circuit (not shown) applies a specific transfer bias to the transfer roller 27 relative to the intermediate transfer belt 51.

The fixing unit 29 is located behind the intermediate transfer belt assembly 25, and includes: a heat roller 61, a pressure roller 63 for pressing the paper 5 to the heat roller 61, and a pair of first transportation rollers 65 disposed downstream from the heat roller 61 and pressure roller 63. The heat roller 61 has an outside layer of silicone rubber covering an inside metal layer. A halogen lamp (heat source) is installed inside the inside metal layer.

In the belt photoconductor assembly 31, the first OPC belt roller 39 is located opposite and behind the four developer cartridges 35 at a position below the lowest cartridge, that is, yellow developer cartridge 35Y. The first OPC belt roller 39 is a driven roller that rotates following the drive roller 41.

The second OPC belt roller 41 is located vertically above the first OPC belt roller 39 at a height above the top cartridge, that is, the black developer cartridge 35K. The second OPC belt roller 41 is a drive roller that rotates when driven by the main motor (not shown) via drive gears (not shown).

The third OPC belt roller 43 is located diagonally behind and above the first OPC belt roller 39. The third OPC belt roller 43 is also a driven roller that rotates following the drive roller 41. The first OPC belt roller 39, second OPC belt roller 41, and third OPC belt roller 43 are thus arranged in a triangle.

The potential applying unit 47 is located near the second OPC belt roller 41, and electrically charges the second OPC belt roller 41 to a potential of +800 V (volts) by using a power source provided in the OPC belt charger 45.

The first OPC belt roller 39 and third OPC belt roller 43 are made from a conductive material such as aluminum, and are connected to a ground terminal (not shown). The first OPC belt roller 39 and third OPC belt roller 43 contact a base layer (described below) of the OPC belt 33. The first OPC belt roller 39 and third OPC belt roller 43 hold the potential of the OPC belt 33 to ground in its area where the rollers 39 and 43 contact the belt 33.

The OPC belt 33 is wound around the first OPC belt roller 39, second OPC belt roller 41, and third OPC belt roller 43. When the second OPC belt roller 41 is rotationally driven, the first OPC belt roller 39 and third OPC belt roller 43 also rotate, and the OPC belt 33 moves circularly counterclockwise.

The OPC belt 33 is an endless belt having the 0.08 mm thick base layer (conductive base layer) with a 25 μm thick photosensitive layer formed on one side of the base layer. The base layer is a nickel conductor formed by nickel electroforming. The photosensitive layer is a polycarbonate type resin photoconductor.

As shown in FIG. 1, the OPC belt charger 45 is located below the belt photoconductor assembly 31 in the neighborhood of the first OPC belt roller 39 at a position upstream of the part of the OPC belt 33 exposed by the scanner unit 21. The OPC belt charger 45 is located opposing the OPC belt 33 with a specific gap therebetween so that the OPC belt charger 45 does not contact the OPC belt 33. The OPC belt charger 45 is a scorotron charger, and has a tungsten or other charging wire for positively charging the belt 33 by generating a corona discharge. The OPC belt charger 45 uniformly and positively charges the surface of the OPC belt 33.

The potential gradient controller 49 is located between the second OPC belt roller 41 and first OPC belt roller 39, and contacts the base layer of the OPC belt 33 at a position above the black developer cartridge 35K. The potential gradient controller 49 lowers the potential of the base layer to ground at the point of contact.

Figure 2:
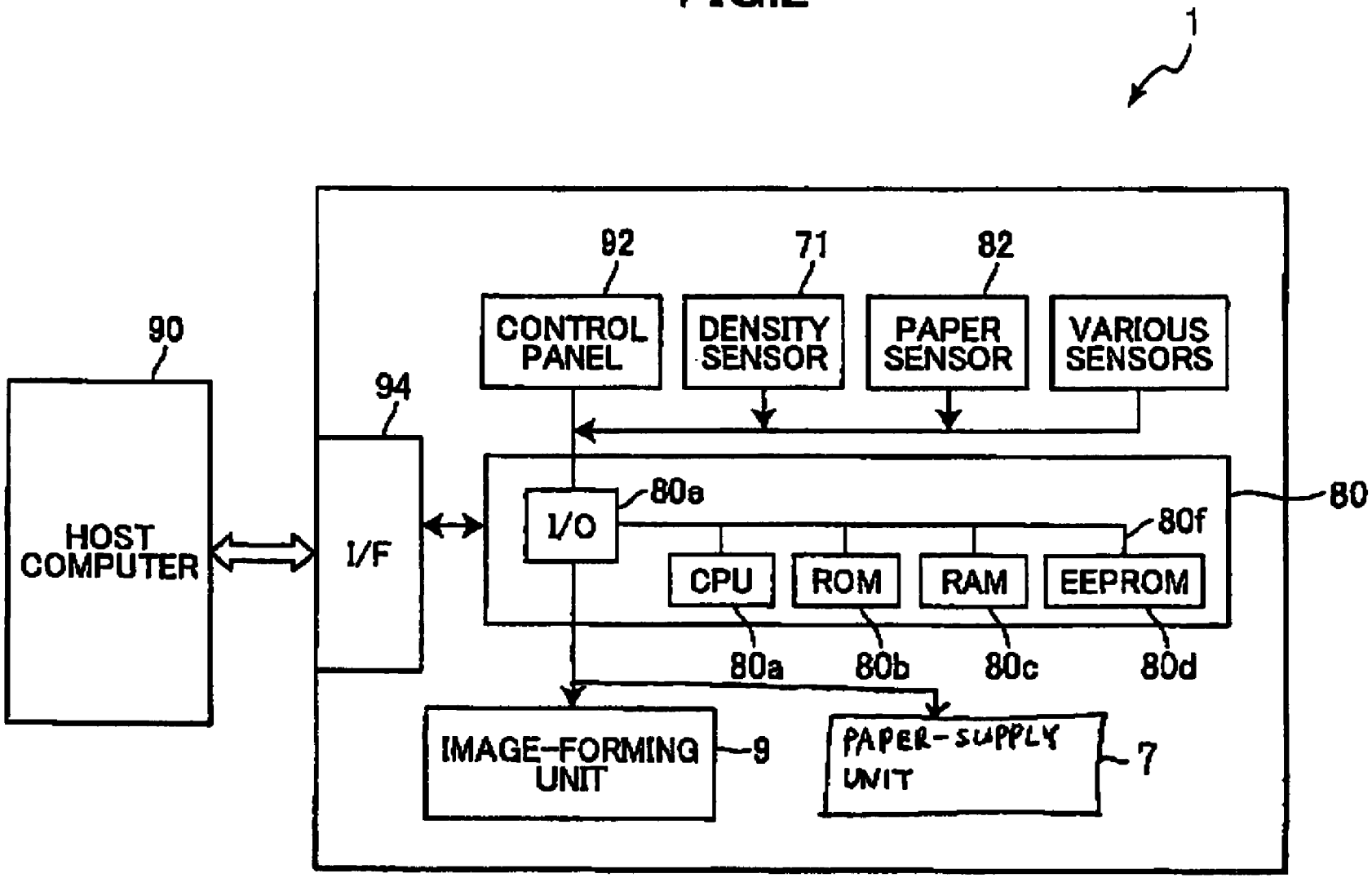
FIG. 2 is a block diagram showing the general electrical configuration of the color laser printer in FIG. 1.

A controller 80 is provided in the printer 1. As shown in FIG. 2, the controller 80 is electrically connected to various sensors, such as the density sensor 71, a paper sensor 82, and other sensors. The paper sensor 82 is for detecting the density of paper 5. A control panel 92 is also electrically connected to the controller 80. The controller 80 performs control based on data received from the various sensors and based on data received from the control panel 92.

The controller 80 is also connected to an external host computer 90 via an interface 94 and is configured to receive image data from the external host computer 90.

For a print job, the controller 80 receives, from the external host computer 90, one group of image data indicative of an image desired to be formed on at least one page's worth of sheet of paper 5. The one group of image data includes a plurality of sets of pixel data for a plurality of pixels that constitute the desired image. Each set of pixel data includes density levels C, M, Y, and K for the toner color components of cyan, magenta, yellow, and black, respectively. Each set of pixel data is indicated as (C, M, Y, K). Each density level C, M, Y, or K is represented by a value in a predetermined range of 0 to 255, and indicates a density level (input density level) within a predetermined range of 0 to 100%. For example, as shown in FIG. 5(*a*), one set of pixel data (C, M, Y, K) for pixel P includes a density level C of 45, a density level M of 60, a density level Y of 50, and a density level K of 125. The density level C of 45 indicates a density of [45/255]×100%, the density level M of 60 indicates a density of [60/255]×100%, the density level Y of 50 indicates a density of [50/255]×100%, and the density level K of 125 indicates a density of [125/255]×100%.

The controller 80 is also connected to the paper supply unit 7 and to the image-forming unit 9. The controller 80 controls various components in the paper supply unit 7 and the image-forming unit 9 by issuing electrical signals thereto.

The controller 80 controls the paper supply unit 7 and the image forming unit 9 to execute the following operations (1)-(5) in order to print a one page's worth of image on one page's worth of paper 5:

(1) The supply roller 13 applies pressure to the top sheet of paper 5 stored in the paper tray 11 such that rotation of the supply roller 13 delivers the paper 5 one sheet at a time into the paper transportation path. The paper 5 is then supplied to the image formation position by the transportation rollers 15 and registration rollers 17. The registration rollers 17 adjust the orientation of the paper 5.

(2) After the surface of the OPC belt 33 is uniformly charged by the OPC belt charger 45, the OPC belt 33 is exposed by high speed scanning of the laser beam from the scanner unit 21 based on image data for yellow toner. Because the charge is removed from the exposed areas, an electrostatic latent image having positively charged parts and uncharged parts is formed on the surface of the OPC belt 33 according to the image data. The first OPC belt roller 39 and third OPC belt roller 43 supply electric current to the base layer of the OPC belt 33 in contact therewith, and thus hold the potential of the contact area to ground.

The yellow separation solenoid 38Y then moves the yellow developer cartridge 35Y horizontally to the rear towards the OPC belt 33 on which the electrostatic latent image is formed so that the developer roller 37Y contacts the OPC belt 33 on which the electrostatic latent image is formed. At this time, the magenta developer cartridge 35M, cyan developer cartridge 35C, and black developer cartridge 35K are each moved horizontally towards the front, that is, away from the OPC belt 33, by the respective separation solenoids 38M, 38C, 39K, and are thus separated from the OPC belt 33.

The yellow toner in the yellow developer cartridge 35Y is positively charged, and thus adheres only to the uncharged areas of the OPC belt 33. A visible yellow image is thus formed on the OPC belt 33.

The visible yellow image formed on the OPC belt 33 is then transferred to the surface of the intermediate transfer belt 51 as the OPC belt 33 moves and contacts the intermediate transfer belt 51. It is noted that a forward bias (+300 V potential) is applied by the power source in the OPC belt charger 45 to the second OPC belt roller 41 at this time, thereby charging the photosensitive layer of the belt 33 near the second OPC belt roller 41 to a +300 V potential through the intervening conductive base layer. This produces a repulsive force between the positively charged yellow toner and the photosensitive layer of the belt 33, and facilitates transferring the toner to the intermediate transfer belt 51.

(3) An electrostatic latent image for magenta is formed on the OPC belt 33, a visible magenta toner image is then formed, and the visible magenta toner image is transferred to the intermediate transfer belt 51 in the same manner as described above for yellow.

More specifically, an electrostatic latent image is formed on the OPC belt 33 for the magenta color component, and the magenta developer cartridge 35M is moved horizontally by the magenta separation solenoid 38M to the back so that the developer roller 37M contacts the OPC belt 33. At the same time, the yellow developer cartridge 35Y, cyan developer cartridge 35C, and black developer cartridge 35K are moved horizontally to the front by the respective separation solenoids 38Y, 38C, 38K and thus separated from the OPC belt 33. As a result, a visible magenta toner image is formed on the OPC belt 33 by the magenta toner stored in the magenta developer cartridge 35M. In the same manner as described above for the yellow image, when the OPC belt 33 moves so that the magenta image becomes opposing the intermediate transfer belt 51, the magenta toner image is transferred to the intermediate transfer belt 51 over the previously transferred yellow toner image.

The same operation is then repeated for the cyan toner stored in the cyan developer cartridge 35C and the black toner stored in the black developer cartridge 35K, thereby forming a full-color image on the intermediate transfer belt 51.

(4) The transfer roller 27 is then set to the transfer position. The full-color image formed on the intermediate transfer belt 51 is transferred at one time to the paper 5 by the transfer roller 27 as the paper 5 passes between the intermediate transfer belt 51 and the transfer roller 27.

(5) The heat roller 61 then thermally fixes the full-color image, which is now transferred on the paper 5, as the paper 5 passes between the heat roller 61 and pressure roller 63. The first pair of transportation rollers 65 then convey the paper 5, on which the full-color image has been thermally fixed by the fixing unit 29, to a pair of discharge rollers. The discharge rollers then discharge the paper 5 conveyed thereto onto a discharge tray formed on the top of the main case 3. The color laser printer 1 thus prints a full-color image onto the paper 5.

The controller 80 is made up of a common microcomputer which has a CPU 80*a*, a ROM 80*b*, a RAM 80*c*, an EEPROM 80*d*, an input/output interface (I/O) 80*e*, and bus lines 80*f* which interconnect the CPU 80*a*, ROM 80*b*, RAM 80*c*, EEPROM 80*d*, and I/O 80*e* with one another. Any other type of nonvolatile memory can be used instead of the EEPROM 80*d*. Any other type of volatile memory can be used instead of the RAM 80*c*.

The ROM 80*b* is prestored with: a printing program which will be described later with reference to FIG. 3(*a*) and FIG. 3(*b*)) a patch-to-image-density table T1 of FIG. 6(*a*); and a patch-density-group table T2 of FIG. 6(*b*).

As shown in FIG. 6(*b*), the patch-density-group table T2 stores therein several (six, in this example) different groups of patch densities A to F. Each patch density group includes several (five, in this example) different density levels. For example, patch density group A includes five different density levels of 10%, 15%, 20%, 25%, and 30%.

As shown in FIG. 6(*a*), the patch-to-image-density table T1 indicates a one-to-one correspondence between the six patch density groups A-F and several density-distribution-states, one of which images to be formed by the printer 1 will possibly possess.

Figure 3A:
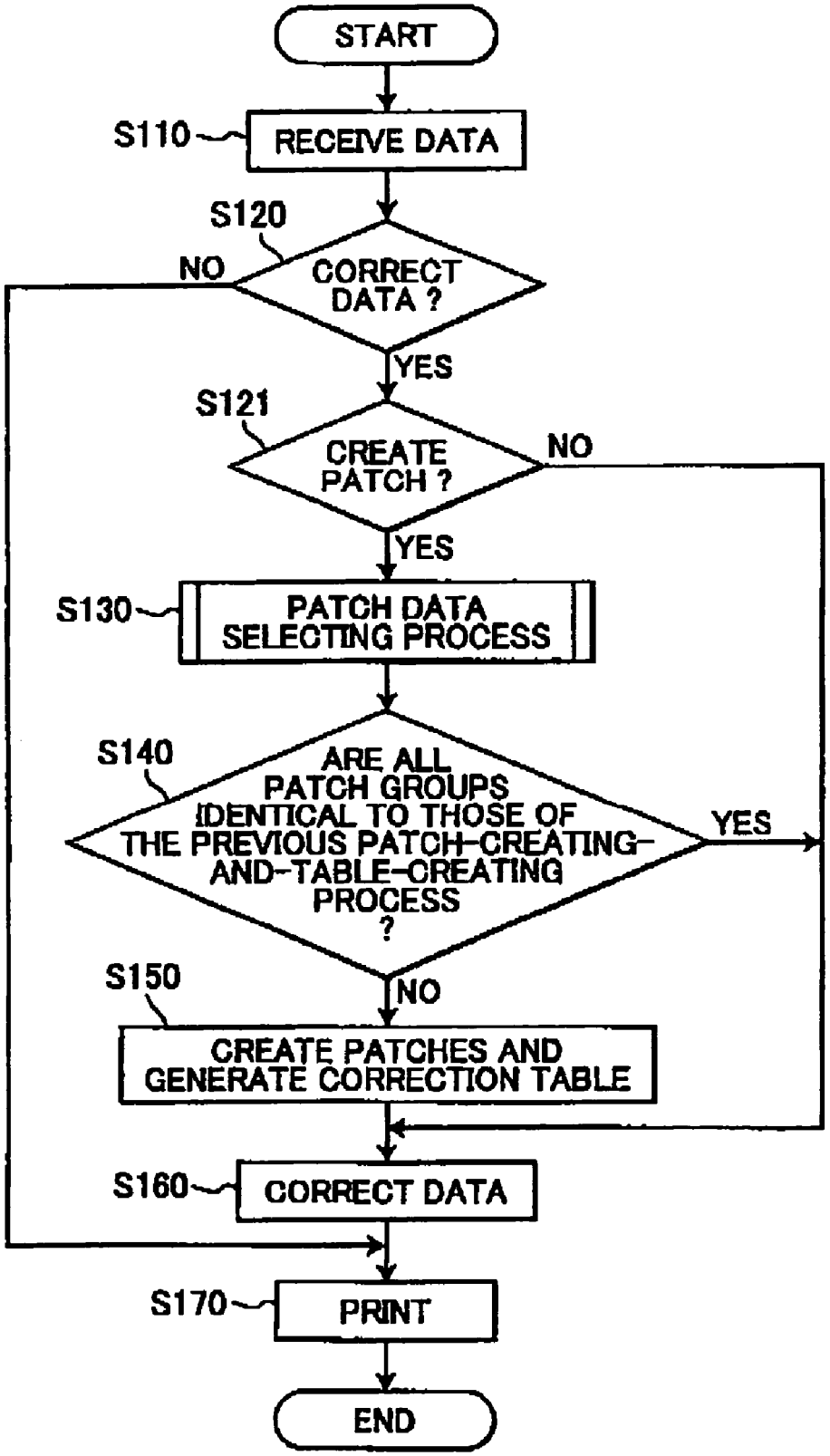
FIG. 3(*a*) is a flowchart illustrating steps in a printing process executed by the color laser printer of FIG. 1 according to the first embodiment.
Figure 3B:
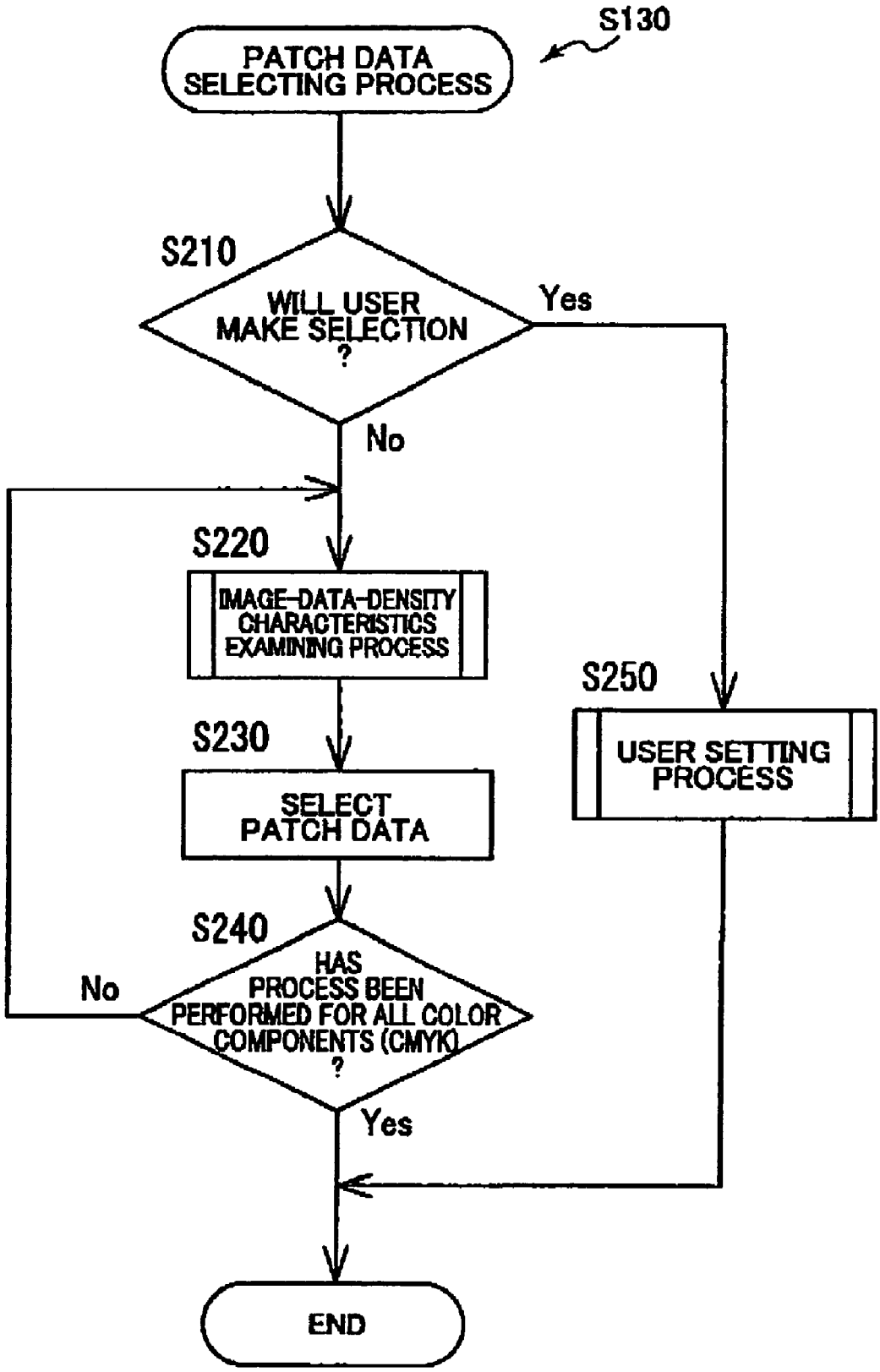

The controller 80 controls operation of the color laser printer 1 by executing the printing program of FIG. 3(*a*) and FIG. 3(*b*).

Figure 4A:
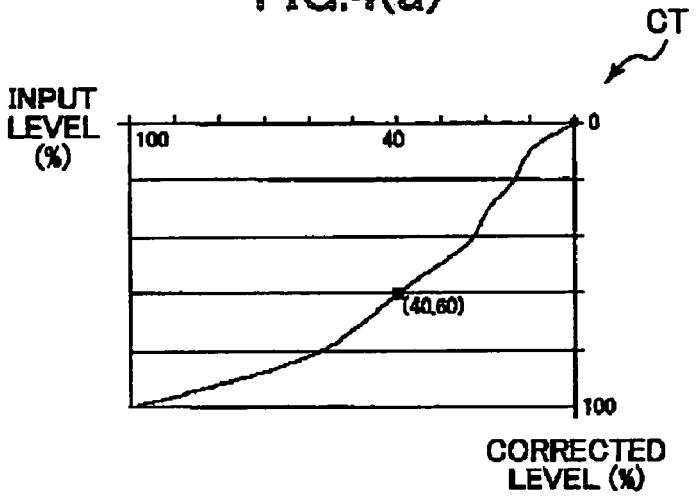
FIG. 4(*a*) illustrates a graph showing an example of a correction table.
Figure 4B:
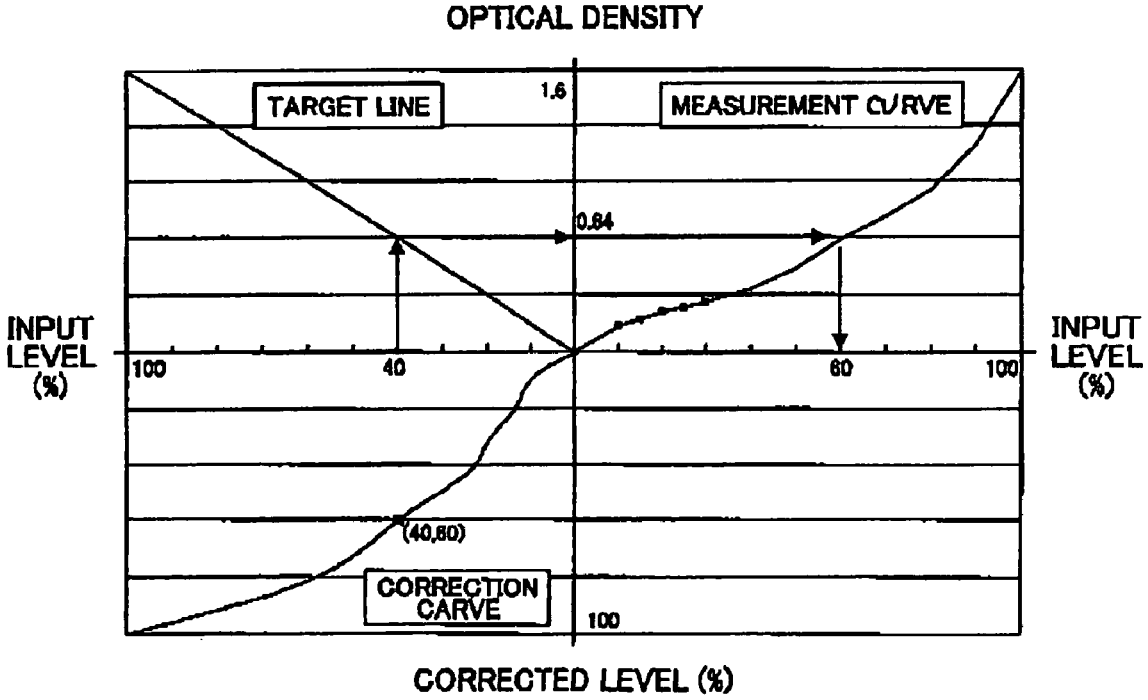

The RAM 80*c* or the EEPROM 80*d* is used to store a correction table CT for each toner color C, M, Y, or K. One example of the correction table CT is shown in FIG. 4 (*a*). The correction table CT indicates a corrected density level in the range of 0% to 100% in correspondence with each input density level in the range of 0% to 100%. In the example of FIG. 4(*a*), the correction table CT indicates that an input density level of 40% should be corrected into 60%.

It is noted that the correction table CT is generated in S150 (FIG. 3(*a*)) for each color based on one patch density group that is selected in S130 (FIG. 3(*a*)) for the subject color from among the patch density groups A to F (FIG. 6(*b*)). The RAM 80*c* or the ESPROM 80*d* is also used in S150 to store the patch density group that is selected in S130 for generating the correction table CT.

The RAM 80*c* is used also to store other various results which are calculated during the printing process of FIG. 3(*a*) and FIG. 3(*b*).

The controller 80 performs a print job by executing the printing program as shown in FIG. 3(*a*) and FIG. 3(*b*).

The controller 80 first receives one group of image data for a present job from the external host computer 90 in S110. The one group of image data includes a plurality of sets of pixel data desired to be printed during the present job.

Next, in S120, the controller 80 determines whether or not to correct the image data.

It is noted that before the printing process of FIG. 3(*a*) is started being executed, a user has already manipulated the control panel 92 or the host computer 90 to input his/her instruction indicating whether or not to correct image data. Data of the inputted instruction is stored in the RAM 80*c*. Therefore, in S120, the controller 80 refers to the RAM 80*c* and checks the data of the instruction.

If the instruction indicates the user's desire not to correct image data (no in S120), the program proceeds directly to S170.

In S170, the controller 80 controls the image forming unit 9 and the paper supply unit 7 to print the image data for the present print job on a required number of sheets of paper 5. More specifically, the controller 80 controls the image forming unit 9 and the paper supply unit 7 to perform the above-described operations (1)-(5) repeatedly the required pages' number of times. The controller 80 sets, based on the image data, the pulse width of the laser beam, the voltage applied to the developing rollers 37, and charges to be applied from the photosensitive belt charger 45.

On the other hand, if the instruction indicates the user's desire to correct image data (yes in S120), the program proceeds to S121.

In S121, the controller 80 determines whether or not to update the correction table CT of FIG. 4(*a*), which is being presently stored in the RAM 80*c* or EEPROM 80*d*, by judging whether or not the present print job meets a predetermined condition. In this example, the controller 80 judges whether or not a predetermined number of sheets have been printed since the correction table CT has been updated latest.

If the predetermined number of sheets have been printed, it is known that the correction table CT should be updated. In this case, the controller 80 determines that the present print job meets the predetermined condition and makes an affirmative determination (yes in S121).

On the other hand, if the predetermined number of sheets have not yet been printed, it is known that the correction table CT should not yet be updated. In this case, the controller 80 determines that the present print job does not meet the predetermined condition and makes a negative determination (no in S121).

It is noted that the controller 80 may judge in S121 whether or not a predetermined period of time has elapsed since the correction table CT has been updated latest. If the predetermined period of time has been elapsed, it is known that the correction table CT should be updated. In this case, the controller 80 determines that the present print job meets the predetermined condition and makes an affirmative determination (yes in S121). On the other hand, if the predetermined period of time has not yet been elapsed, it is known that the correction table CT should not yet be updated. In this case, the controller 80 determines that the present print job does not meet the predetermined condition and makes a negative determination (no in S121).

When the controller 80 makes a negative determination (no in S121), the program directly proceeds to S160. In S160, image data is corrected by using the correction table CT of FIG. 4(*a*), which is presently being stored in the RAM 80*c* or EEPROM 80*d*. In this example, if one set of pixel data (C, M, Y, K) for some pixel has an input density level C of 102 (40%) and if the correction table CT shown in FIG. 4(*a*) is for cyan toner color, the input density level C is corrected into 153 (60%).

Then, in S170, the controller 80 controls the sheet supply unit 7 and the image forming unit 9 to perform the above-described operations (1)-(5) repeatedly the required pages' number of times, while setting the pulse width of the laser beam, the amount of the voltage applied to the developing rollers 37, and the amount of charges to be applied from the photosensitive belt charger 45 based on the corrected image data.

On the other hand, when the controller 80 makes an affirmative determination (yes in S121), the program proceeds to a patch data selecting process of S130.

The patch data selecting process of S130 will be described below with reference to FIG. 3(*b*).

First, in S210, the controller 80 determines whether patch data is to be selected by the user. The controller 80 performs this determination based on the user's instruction inputted to the control panel 92.

If the user is to make the selection (S210: YES), then in S250 a user setting process is performed.

In S250, for each toner color, one patch density group is selected from among all the six patch density groups A-F in the patch-density-group table T2 (FIG. 6(*b*)) according to data inputted by the user through the control panel 92. This process enables the user to input the control panel 92 with his/her desired settings for the four toner colors independently from one another. The controller 80 sets patch density groups for the respective toner colors based on the inputted settings. For example, a patch density group A is set for the yellow component, a patch density group C for the cyan component, a patch density group B for the yellow component, and a patch density group D for the black component.

Since patch density groups are selected according to data inputted through the control panel 92, it is possible to generate measurement patches that reflect the user's wishes. In other words, when the user selects patch density groups dependently on the printing environment, the controller 80 can generate correction tables CT that reflect the printing environment.

When the patch data selecting process of S130 is completed, and the program proceeds to S140 in FIG. 3(*a*).

On the other hand, if the user is not to make the selection (S210: no), then the program proceeds to S220.

In S220, an image-data-density characteristics examining process is executed onto the image data for one color component. Next, in S230, dependently on a result of the image-data-density characteristics examining process of S220 for the color component, one patch density group is selected for the subject color component from among all the patch density groups A-F in the patch-density-group table T2.

Next, in S240, the controller 80 judges whether or not the image-data-density characteristics examining process of S220 and the patch-density-group selecting process of S230 are executed for all the color components of cyan, magenta, yellow, and black.

If the image-data-density characteristics examining process of S220 and the patch-density-group selecting process of S230 have not yet been executed for all the color components of cyan, magenta, yellow, and black (no in S240), the program returns to S220. The processes of S220-S240 are executed repeatedly until the processes of S220 and S230 have been executed for all the color components of cyan, magenta, yellow, and black.

On the other hand, if the processes of S220 and S230 have been executed for all the color components of cyan, magenta, yellow, and black (yes in S240), the program returns to S140 in FIG. 3(*a*). In this way, patch density groups are selected independently for the respective toner colors.

The image-data-density characteristics examining process of S220 and the patch-density-group selecting process of S230 will be described below in greater detail with reference to FIG. 5(*a*) and FIG. 5(*b*).

It is now assumed that the processes of S220 and S230 are executed for the cyan toner color component. The image-data-density characteristics examining process of S220 and the patch-density-group selecting process of S230 are executed for other color components in the same manner as for the cyan color component.

The image-data-density characteristics examining process of S220 and the patch-density-group selecting process of S230 are executed for the cyan color component as will be described later.

In S220, for the present color component (cyan color component, in this example), the controller 80 examines density distribution in a predetermined part of an image to be printed in the present printing job. In this example, the controller 80 examines density distribution in the entire part of the image to be printed in the present printing job. Accordingly, if the present printing job is to print the image onto several pages, the controller 80 examines overall density distribution in all the several pages' worth of image in the print job.

It is noted, however, that in S220, the controller 80 may examine density distribution in only one page's worth of image out of the several pages' worth of image. Or, the controller 80 may examine density distribution in some other arbitrary part in the image to be printed in the present printing job.

In order to examine density distribution for cyan color component in the predetermined part of the image, the controller 80 sorts a plurality of pixels (C, M, Y, K), which are located in the predetermined part of the image, into four different density ranges I (0-63), II (64-127), III (128-191), and IV (192-255) according to their cyan-component density levels C. For example, the controller 80 sets the pixel P (45, 60, 50, 125) shown in FIG. 5(*a*) into the density range I.

According to the examination of S220, it is known what portions of the pixels in the predetermined part of the image have cyan densities in the ranges I (0-63), II (64-127), III (128-191), and IV (192-255), respectively. The controller 80 therefore creates a density-distribution table T3 as shown in FIG. 5(*b*) in the RAM 80*c*. The density-distribution table T3 indicates what portion in all the pixels in the predetermined part of the image has densities falling in each density-range I, II, III, or IV. In other words, the density-distribution table T3 indicates, in correspondence with each density range I, II, III, or IV, the ratio (percentage) of the number of pixels, which have densities in the subject density range, to the total number of pixels in the predetermined part of the image.

It is now assumed that the density-distribution table T3 is set as shown in FIG. 5(*b*) for cyan color component. The density-distribution table T3 shows that for the cyan component, a 10% portion in the pixels in the predetermined part of the image has densities in the range I (0-63), that a 15% portion has-densities in the range II (64-127), that a 50% portion has densities in the range III (128-191), and that a remaining 25% portion has densities in the range IV (192-255).

In S230, the controller 80 refers to the density-distribution table T3 (FIG. 5(*b*)) and the patch-to-image-density table T1 (FIG. 6(*a*)), and selects one patch density group from the patch-density-group table T2 (FIG. 6(*b*)).

The process in S230 will be described below in greater detail.

The controller 80 first examines the density-distribution table T3 to judge whether or not the ratio of the number of pixels within each of at least one density range I, II, III, or IV exceeds a predetermined threshold value (30% in this example). If the ratio of the number of pixels within one density range I, II, III, or IV exceeds the threshold value and if the ratio of the number of pixels within each of the other remaining density ranges does not exceed the threshold value, it is known that there is a bias toward the subject density range, within which the ratio of the number of pixels exceeds the threshold. On the other hand, if the ratios of the numbers of pixels within more than one density range exceed the threshold value, then it is known that there is a bias toward a density range having the largest number of pixels among the more than one density range. If the ratio of the number of pixels within no density range I, II, III, or IV exceeds the predetermined threshold value, it is known that there is no particular bias.

When there is a bias toward the density range I, by referring to the patch-to-image-density table T1 (FIG. 6(*a*)), it is known that a patch density group A, which has densities in the range of 10 to 30% as shown in FIG. 6(*b*) and therefore which has a relatively strong bias toward the lighter direction, should be selected.

When there is a bias toward the density range II, it is known that a patch density group B, which has densities in the range of 25 to 50% as shown in FIG. 6(*b*) and therefore which has a relatively weak bias toward the lighter direction, should be selected.

When there is a bias toward the density range III, it is known that a patch density group C, which has densities in the range of 45 to 65% as shown in FIG. 6(*b*) and therefore which has a relatively weak bias toward the darker direction, should be selected.

When there is a bias toward the density range IV, it is known that a patch density group D, which has densities in the range of 60 to 80% as shown in FIG. 6(*b*) and therefore which has a relatively strong bias toward the darker direction, should be selected.

If there is no particular bias, it is known that the patch density group E, which has no particular bias in density as shown in FIG. 6(*b*), should be selected.

It is noted that the patch density group F should be selected as a default.

In the example of the density-distribution table T3 of FIG. 5(*b*), there is a bias toward the density range III. It is therefore known that the patch density group C should be selected.

By knowing a density range, to which the largest number of pixels, greater than 30% of the total number of pixels, belongs, it is possible to learn with accuracy which density range occupies the largest area in the predetermined part of the image and to learn with greater accuracy the tendencies in which the image is dark or light within the predetermined range.

Different groups of patch densities are given as shown in FIG. 6(*b*) and the groups of patch densities are associated with density distribution of images as shown in FIG. 6(*a*) so that darker measurement patches will be selected when the densities are greater in density ranges having the greatest concentration of pixels and so that lighter measurement patches will be selected when the densities are smaller in density ranges having the greatest concentration of pixels.

Hence, if the greatest number of pixels is in the darkest range IV and therefore the overall image appears relatively highly dark, then a darkest patch density group D in FIG. 6(*b*) is selected.

If the greatest number of pixels is in the second darkest range III and therefore the overall image appears relatively slightly dark, then a second darkest patch density group C in FIG. 6(*b*) is selected If the greatest number of pixels is in the lightest range I and therefore the overall image appears relatively highly light, then a lightest patch density group A in FIG. 6(*b*) is selected.

If the greatest number of pixels is in the second lightest range II and therefore the overall image appears relatively slightly light, then a second lightest patch density group B in FIG. 6(*b*) is selected.

In this way, the controller 80 determines the overall density characteristics of the predetermined part in the image by determining the density distribution in the predetermined part of the image. In other words, the controller 80 determines the density range, to which the largest number of pixels belongs within the predetermined part of the image, and sets this density range as a level indicating the overall degree of density within the predetermined part. This level is called the "overall density level" in the predetermined part of the image. Hence, if the density range, to which the greatest number of pixels belongs, is a relatively dark range, the controller 80 determines that the overall density level of the predetermined part in the image to be relatively dark. Conversely, if this density range is a relatively light range, then the controller 80 determines that the overall density level of the predetermined part in the image to be relatively light. Then, the controller 80 selects a patch density group that is appropriate to the determined density level from among the several patch density groups.

It is noted, however, that it is unnecessary to determine the density distribution in the predetermined part of the image in order to determine the overall density characteristics in the predetermined part of the image. For example, the controller 80 may accumulate the density values of the pixels located in the predetermined part of the image and then to determine that the overall density level of the predetermined part in the image is relatively dark when the accumulated total density is relatively large and relatively light when the accumulated total density is relatively small.

After a patch density group is thus selected for each of all the color components (yes in S240) and the patch data selecting process of S130 is completed, the program proceeds to S140 (FIG. 3(*a*)).

In S140, the controller 80 examines changes from the overall density characteristics of the image data from the overall density characteristics of the image data that have been used in a latest-executed patch-creating-and-table-creating process of S150.

More specifically, the controller 80 judges, for each toner color, whether or not the patch density group that is selected in S130 during the present print job is the same as a patch density group that has been used in the latest-executed patch-creating-and-table-creating process of S150 (to be described later) to create the correction table CT which is presently being stored in the RAM 80*c* or the EEPROM 80*d*.

It is noted that data of the patch density groups used in the previous patch-creating-and-table-creating process of S150 are stored in the RAM 80*c* or the EEPROM 80*d* for all the toner colors, enabling the controller 80 to confirm changes in the patch density groups for all the colors based on the current patch density groups and the previous patch density groups stored in memory.

If, for each of all the toner colors, the patch density group that is selected in S130 during the present printing process is the same as a patch density group that has been used in the latest-executed patch-creating-and-table-creating process of S150 (S140: YES), then the program proceeds to S160 without executing the patch-creating-and-table-creating process of S150. In S160, image data is corrected in S160 by using the correction table CT which is presently being stored in the RAM 80*c* or the EEPROM 80*d*, and the printing process is executed in S170 by using the corrected image data.

On the other hand, if for at least one toner color, the patch density group that is selected in S130 during the present printing process differs from the patch density group that has been used in the latest-executed patch-creating-and-table-creating process of S150 (S140: NO), then in S150 a measurement patch group is created for each of all the colors based on the newly-selected patch density group, and a correction table CT is newly created for each of all the colors by measuring the created measurement patch group.

In this way, measurement patch groups are generated when a predetermined condition that "the previously used patch density group differs from the currently set patch density group for at least one color component" is met and are not generated when this condition is not met. Accordingly, the process for generating measurement patches and for creating the correction tables CT is performed only when this condition is met, improving the efficiency of the process.

In other words, measurement patches are not generated based on the currently-set patch density group when there are only minor changes between density characteristics of image data, based on which the current patch density groups are determined, and density characteristics of image data, based on which the previously-used patch density groups have been determined. It is possible to improve the efficiency of the entire process while maintaining accuracy of correction and also to improve processing speed.

Next, the patch-creating-and-table-creating process of S150 will be described in greater detail with reference to FIG. 4(*a*), FIG. 4(*b*), and FIG. 7.

It is now assumed that the image defined by the image data for the present job has many pixels in very light range in its black and magenta components, has many pixels in slightly light range in its cyan component, and has many pixels in slightly dark range in its yellow component. In other words, that the image has very light characteristics in its black and magenta components, has slightly light characteristics in its cyan component, and has slightly dark characteristics in its yellow component. It is further assumed that during the patch data selecting process of S130, the patch density groups A are selected for the black and magenta color components K and M, the patch density group B is selected for the cyan color component C, and the patch density group C is selected for the yellow color component Y.

Figure 7:
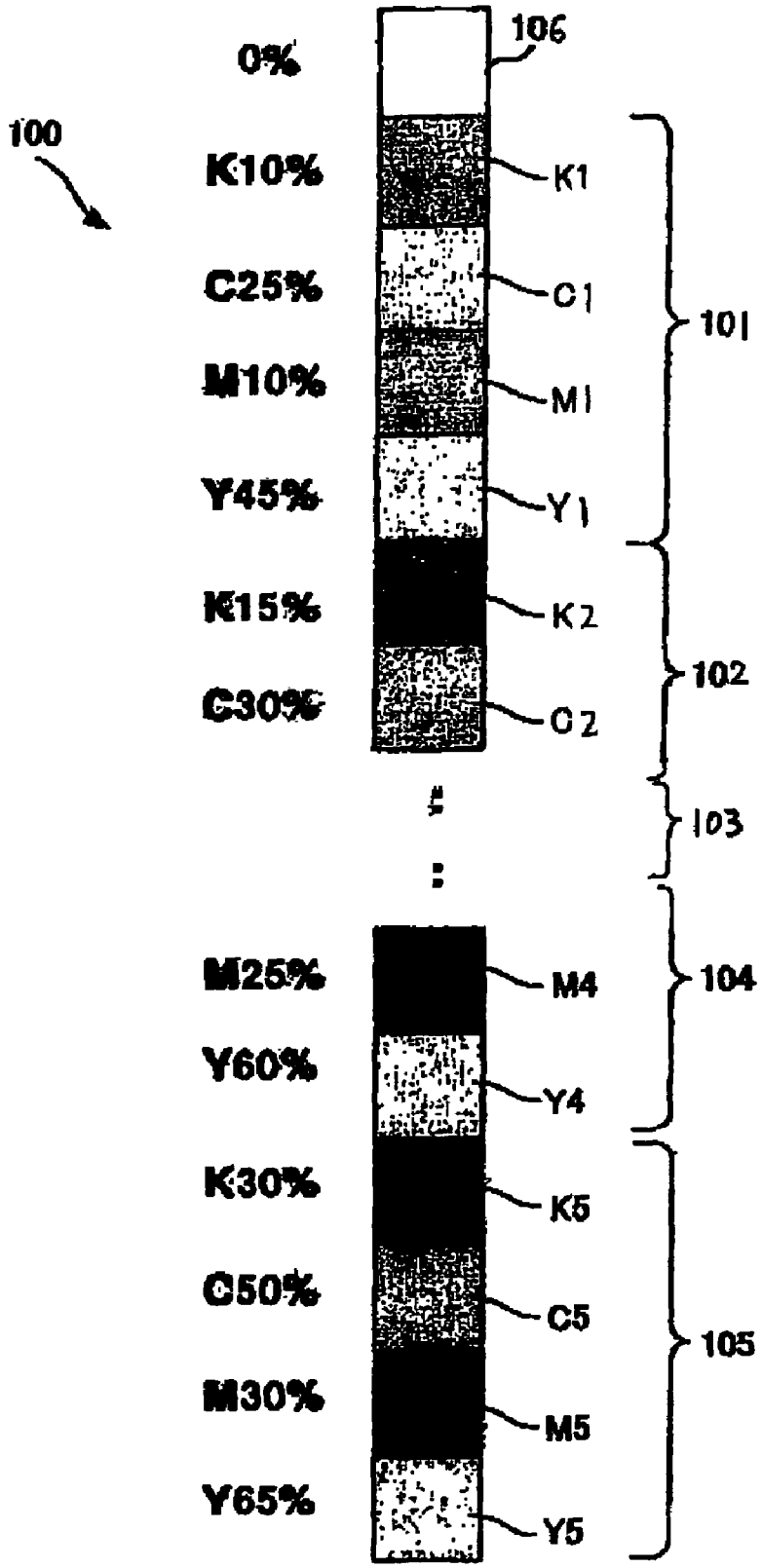
FIG. 7 is an explanatory diagram showing a conceptual example of a series of measurement patches formed in four toner colors of black, cyan, magenta, and yellow.

In S150, first, a series of measurement patches 100 is formed on the intermediate transfer belt 51 as shown in FIG. 7. The measurement patch sequence 100 is not transferred on the paper 5. The measurement patch sequence 100 is formed on the intermediate transfer belt 51 in a straight line extending along the direction of movement of the intermediate transfer belt 51 but accommodated within one cycle. The measurement patch sequence 100 includes a combination of measurement patches for all the four colors.

Specifically, the measurement patch sequence 100 is configured of: a reference measurement patch 106; a lightest measurement patch group 101; a second lightest measurement patch group 102; a middle-density measurement patch group 103; a second darkest measurement patch group 104; and a darkest measurement patch group 105, which are arranged in this order along the movement direction of the intermediate transfer belt 51.

The reference measurement patch 106 is formed based on density data of zero (0)%.

The lightest measurement patch group 101 includes: a black measurement patch K1, a cyan measurement patch C1, a magenta measurement patch M1, and a yellow measurement patch Y1, each of which is formed based on the lightest density value in the patch density group selected for the corresponding color component. In this example, the measurement patches K1, C1, M1, and Y1 are formed based on the lightest densities 10%, 25%, 10%, and 45% in the patch density data groups A, B, A, and C, respectively.

The second lightest measurement patch group 102 includes: a black measurement patch K2, a cyan measurement patch C2, a magenta measurement patch M2, and a yellow measurement patch Y2, each of which is formed based on the second lightest density value in the patch density group selected for the corresponding color component.

The middle-density measurement patch group 103 includes: a black measurement patch K3, a cyan measurement patch C3, a magenta measurement patch M3, and a yellow measurement patch Y3, each of which is formed based on the middle density value in the patch density group selected for the corresponding color component.

The second darkest measurement patch group 104 includes: a black measurement patch K4, a cyan measurement patch C4, a magenta measurement patch M4, and a yellow measurement patch Y4, each of which is formed based on the second darkest density value in the patch density group selected for the corresponding color component.

The darkest measurement patch group 105 includes: a black measurement patch K5, a cyan measurement patch C5, a magenta measurement patch M5, and a yellow measurement patch Y5, each of which is formed based on the darkest density value in the patch density group selected for the corresponding color component.

In this way, the five black measurement patches K1-K5 are formed based on the five patch densities included in the patch density group selected for black, the five cyan measurement patches C1-C5 are formed based on the five patch densities included in the patch density group selected for cyan, the five magenta measurement patches M1-M5 are formed based on the five patch densities included in the patch density group selected for magenta, and the five yellow measurement patches Y1-Y5 are formed based on the five patch densities included in the patch density group selected for yellow.

The controller 80 forms the measurement patch sequence 100 on the intermediate transfer belt 51 by controlling the paper supply unit 7 and the image forming unit 9 in a manner that is the same as the steps (1)-(3) described above except that the reference measurement patch 106, the black measurement patches K1-K5, cyan measurement patches C1-C5, magenta measurement patches M1-M5, and yellow measurement patches Y1-Y5 are not formed over one another at a single location on the intermediate transfer belt 51, but are formed at positions shifted from one another on the intermediate transfer belt 51 along the direction of movement thereof as shown in FIG. 7.

When the measurement patch sequence 100 is completely formed on the intermediate transfer belt 51, the density (optical density) of each measurement patch is measured by the density sensor 71. More specifically, the density sensor 71 is controlled to measure the measurement patch sequence 100 on the intermediate transfer belt 51 as the intermediate transfer belt 51 is driven circularly while passing the density sensor 71. Because the measurement patch sequence 100 is formed completely within the length of one revolution of the intermediate transfer belt 51, the density sensor 71 can measure the density of all the measurement patches in the measurement patch sequence 100 during one revolution of the intermediate transfer belt 51.

Then, based on the measured results for each color, the controller 80 creates a correction table CT for the subject color in a manner described below.

Following description is for the case where the controller 80 creates a correction table CT for the black component. It is noted that the controller 80 creates a correction table CT for each of the other remaining components in the same manner as for the black component.

Using the optical density values obtained through actual measurements of the measurement patches on the intermediate transfer belt 51, the controller 80 estimates optical density values, which will be obtained if the measurement patches were transferred onto a printing medium 5, as being equal to the measured optical density values. In this example, for black color component, the controller 80 estimates six optical density values, which will be obtained if the reference measurement patch 106 and the black measurement patches K1-K5 were printed on a printing medium 5 based on the density values 0%, 10%, 15%, 20%, 25%, and 30%, as being equal to the optical density values obtained through actual measurements of the reference measurement patch 106 and the black measurement patches K1-K5 formed on the intermediate transfer belt 51.

Then, the controller 80 plots the estimated six optical density values in correspondence with the six density levels of 0%, 10%, 15%, 20%, 25%, and 30% as shown in the upper right quadrant in the graph of FIG. 4(*b*). Then, using an interpolation method well known in the art, the controller 80 calculates optical density values for 256 discrete density levels, which are arranged between 0% and 100% by a uniform interval. Representative examples of the interpolation method include linear interpolation and quadratic interpolation.

In this manner, the controller 80 determines a measurement curve as shown in the upper right quadrant in the graph of FIG. 4(*b*). The measurement curve indicates the printing characteristics of the printer 1. In this example, the measurement curve indicates that when the printer 1 receives density data indicative of an input level of 60%, the printer 1 will print out an optical density of 0.64.

It is noted that a target line indicative of ideal characteristics for the printer 1 is defined as shown in the upper left quadrant in the graph of FIG. 4(*b*). In this example, the target line indicates that when the printer 1 receives density data indicative of an input level of 40%, the printer 1 should ideally print out an optical density of 0.64.

Based on the measurement curve and the target line, the controller 80 calculates a correction curve as shown in the lower left quadrant in the graph of FIG. 4(*b*). The correction curve is for correcting each input level in the range of 0 to 100% into a corrected level, which falls also in the range of 0 to 100% and which can control the printer 1 having the printing characteristics defined by the measurement curve to print out an ideal optical density defined by the target line. In this example, the correction curve is for correcting the input level of 40% into a corrected level of 60%.

The controller 80 then stores the correction curve as the correction table CT shown in FIG. 4(*a*) in the RAM 80*c* or the EEPROM 80*d*. In this way, the correction table CT is updated in the RAM 80*c* or the EEPROM 80*d*. The correction table CT indicates a correspondence between the input level in the range of 0-100% and the corrected level also in the range of 0-100%.

By executing the above-described process for all the toner colors, the correction tables CT for all the toner colors are updated in the RAM 80*c* or the EEPROM 80*d*.

It is noted that data of the patch density groups that are used in the process of S150 to generate the measurement patches is also stored in the RAM 80*c* or the EEPROM 80*d* for all the toner colors. In this way, the patch density groups in the RAM 80*c* or the EEPROM 80*d* are overwritten each time the measurement patches are produced based thereon.

When the correction tables CT and the patch density groups are stored in the RAM 80*c* or the EEPROM 80*d* for all the toner colors, the process of S150 is completed.

In this example, the image data has light characteristics in black component and therefore the patch density group A having measurement patches in light densities of 10 to 30% is selected for black component. The measurement curve for black is prepared through interpolation using a greater number of measured values in the light density range than in the dark density range. The measurement curve can therefore be prepared more precisely in the light density range than in the dark density range. The correction curve determined based on the thus prepared measurement curve is more precise in the light density range than in the dark density range, and therefore can precisely correct the image data that has light characteristics.

Similarly, in this example, the image data has slightly light characteristics in cyan component and therefore the patch density group B having measurement patches in slightly light densities of 25 to 50% is selected for cyan component. Accordingly, the measurement curve for cyan is prepared through interpolation using a greater number of measured values in the slightly light density range than in the other remaining density ranges. The measurement curve can therefore be prepared more precisely in the slightly light density range than in the other remaining density ranges. The correction curve determined based on the thus prepared measurement curve is more precise in the slightly light density range than in the other remaining density ranges, and therefore can precisely correct the image data having the slightly light characteristics.

Similarly, in this example, the image data has slightly dark characteristics in yellow component and therefore the patch density group C having measurement patches in slightly dark densities of 45 to 65% is selected for yellow component. The measurement curve for yellow is prepared through interpolation using a greater number of measured values in the slightly dark density range than in the other remaining density ranges. The measurement curve can therefore be prepared more precisely in the slightly dark density range than in the other remaining density ranges. The correction curve determined based on the thus prepared measurement curve is more precise in the slightly dark density range than in the other remaining density ranges, and therefore can precisely correct the image data having the slightly dark characteristics.

It is noted that one conceivable method for increasing precision using a large number of measured values is to increase the total number of measurement patches. However, a needlessly large amount of measurement patches cannot fit within one cycle of the intermediate transfer belt 51. In such a case, the intermediate transfer belt 51 must revolve more than one cycle to form the measurement patches thereon and to measure the measurement patches, requiring a great amount of time for performing these processes. However, the present embodiment does not needlessly increase the total number of patches and therefore can effectively suppress a delay in processing and increase efficiency.

After the patch-creating-and-table-creating process of S150 is completed, the program proceeds to S160, in which image data is corrected by using the newly-created correction table CT, and printing is performed in S170 based on the corrected image data.

<Modification>

In the above-described embodiment, in S140, when the patch density group currently set for some toner color is different from the previously-used patch density group for the subject toner color (no in S140), then in S150 new measurement patches are generated for all the toner colors and the correction tables CT are generated for all the toner colors.

Figure 8:
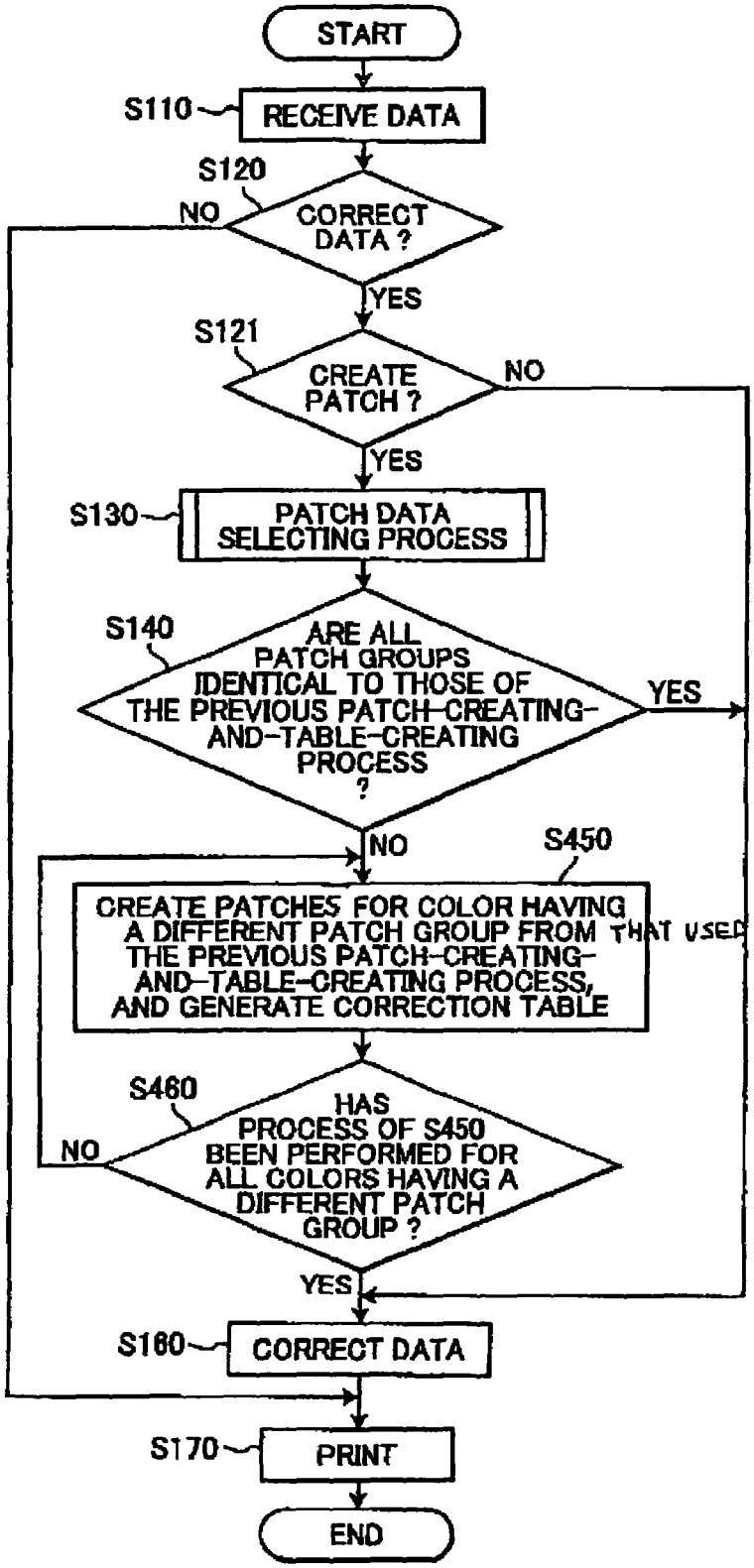
FIG. 8 is a flowchart illustrating steps in a printing process according to a modification of the first embodiment.

However, as shown in FIG. 8, when the patch density group currently set for some toner color is different from the previously-used patch density group for the subject toner color (no in S140), then in S450 new measurement patches may be generated only for the subject toner color and the correction table CT is generated for the subject toner color.

It is noted that when the patch density groups currently set for two or more toner colors are different from the previously-used patch density groups for the same two or more colors (no in S140) then in S450 new measurement patches are generated and the correction table CT is generated for one of the two or more colors. When the process of S450 has not yet been executed for all of the two or more colors (no in S460), the program returns to S450, wherein new measurement patches are generated and the correction table CT is generated for another one of the two or more colors. In this way, the processes of S450 and S460 are repeated until new measurement patches are generated and correction tables CT are generated for all of the two or more colors, for which the currently-set patch density groups are different from the previously-used patch density groups. The contents of the process in S450 are the same as those in the process of S150.

Hence, the process for generating a measurement patch group and for creating the correction table CT is performed only for toner colors that meet the condition that "the currently set patch density group differs from the previously used patch density group." By distinguishing toner colors for which measurement patch generation is necessary and toner colors for which such generation is unnecessary, the process can be made more efficient.

Accordingly, an appropriate density correction can be performed for each toner color, thereby improving correction accuracy.

Second Embodiment

According to a second embodiment, the paper sensor 82 shown in FIGS. 1 and 2 is used to detect the density of the paper 5. The controller 80 adjusts densities of image data and measurement patches based on the detected paper density.

According to the second embodiment, the ROM 80*b* is prestored with: a printing program which will be described below with reference to FIG. 9(*a*), FIG. 9(*b*), and FIG. 9(*c*); and a paper-to-rate table T4 shown in FIG. 10(*a*).

The paper-to-rate table T4 indicates a one-to-one correspondence between several paper density ranges, into one of which a paper density value detected by the paper sensor 82 will possibly fall, and several adjustment rates for patch densities.

Figure 9A:
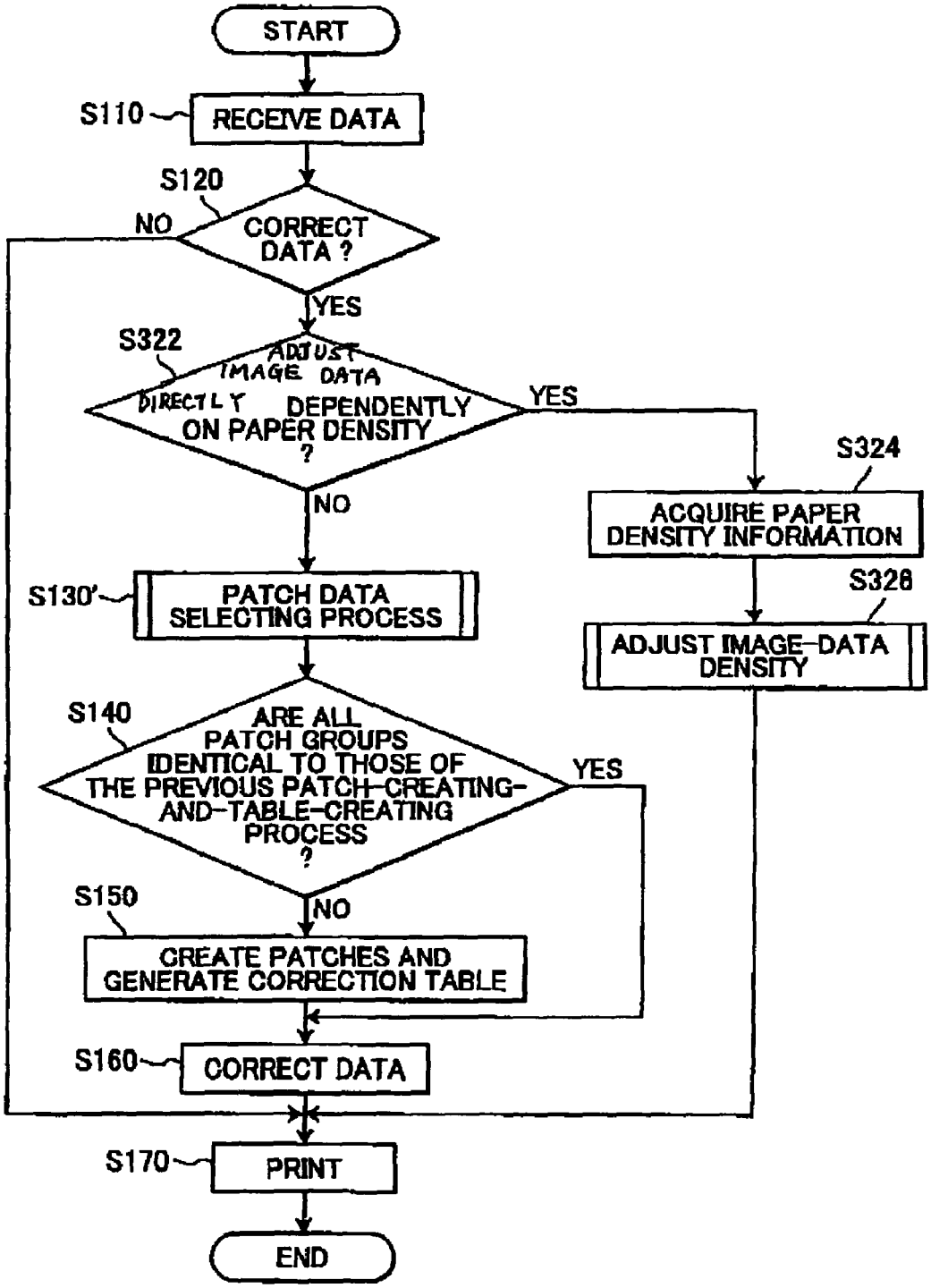
FIG. 9(*a*) is a flowchart illustrating steps in a printing process according to a second embodiment.
Figure 9B:
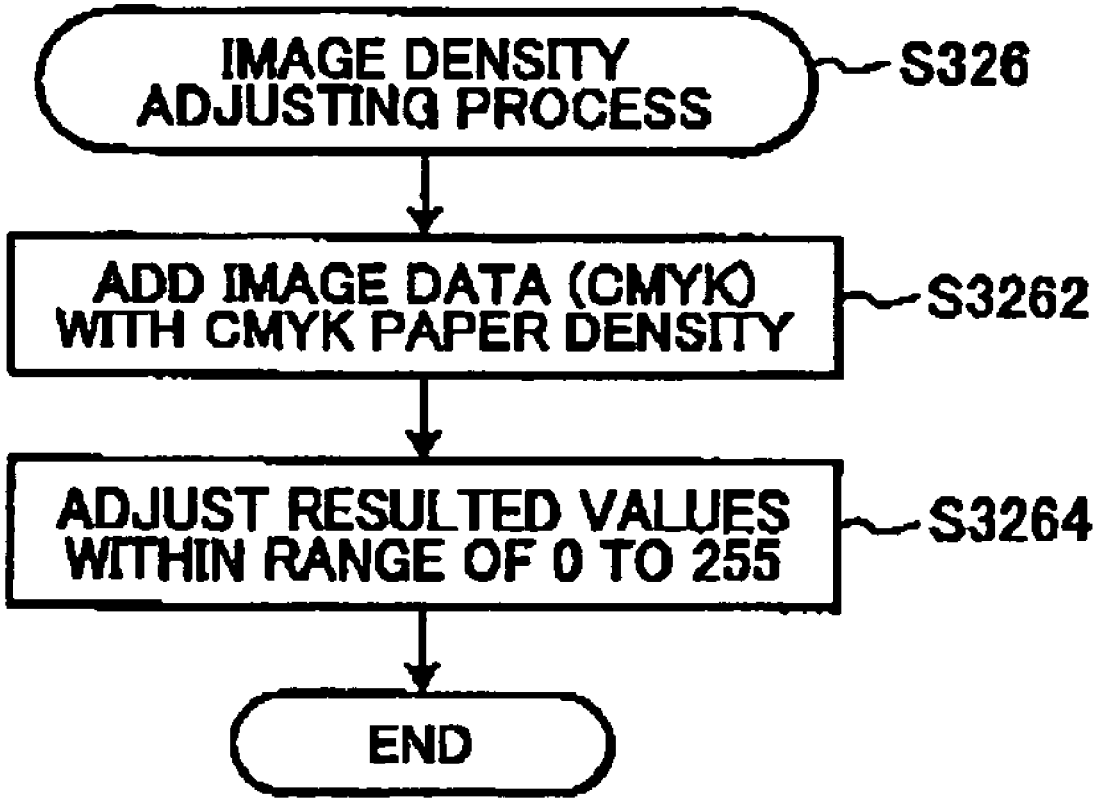
Figure 9C:
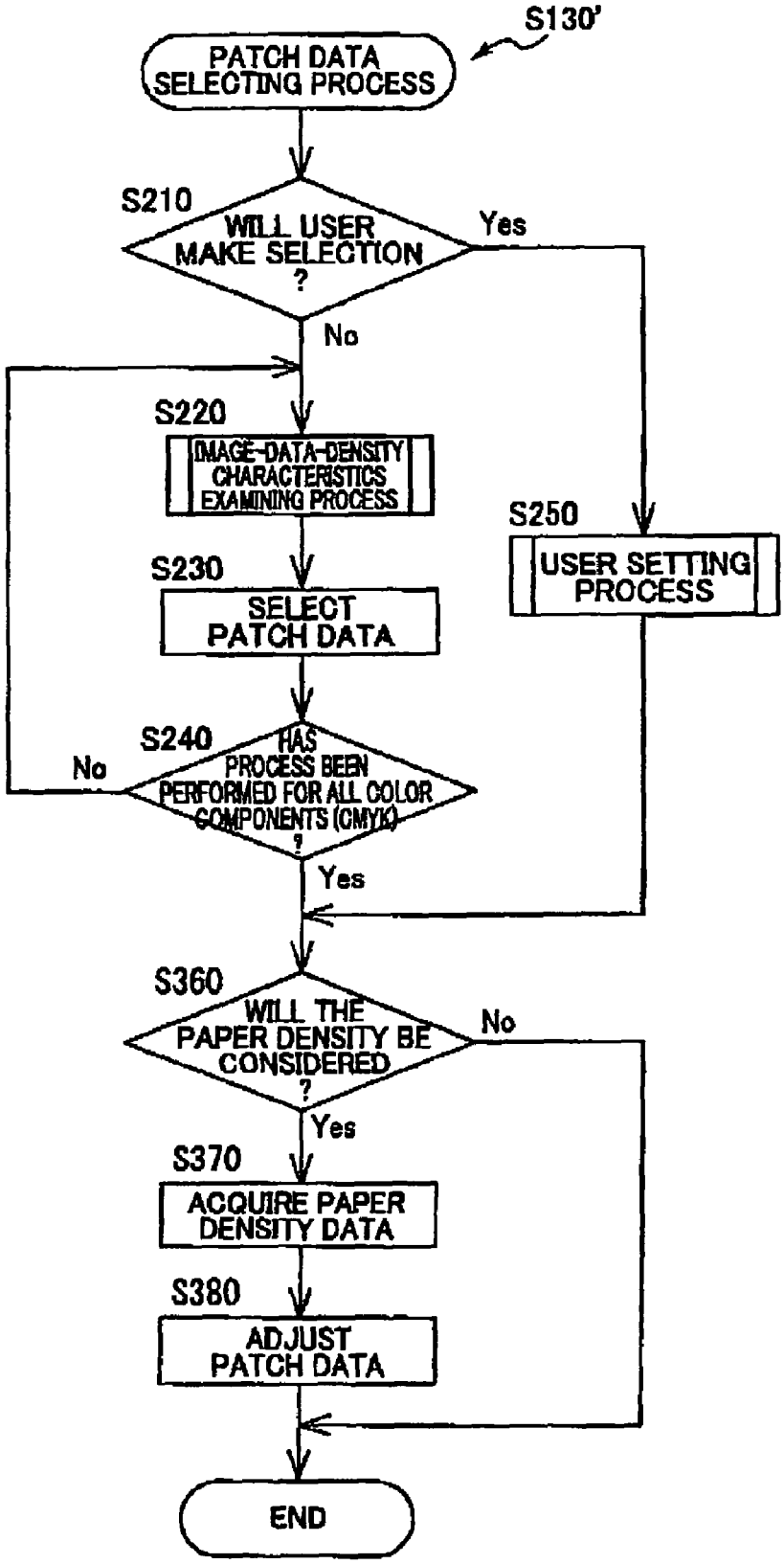

The printing process of FIG. 9(*a*) is different from that of FIG. 3(*a*) in that: the patch data selecting process of S130 is modified into a patch data selecting process of S130'; and the process of S121 is omitted and processes of S322-S326 are added instead.

When image data is to be corrected (yes in S120), the program proceeds to S322, in which the controller 80 judges whether or not to adjust image data directly dependently on density of the paper 5.

It is noted that before the printing process of FIG. 9(*a*) is started being executed, the user has already manipulated the control panel 92 or the host computer 90 to input his/her instruction indicating whether or not to adjust image data directly dependently on density of the paper 5. Data of the inputted instruction is stored in the RAM 80*c*. Therefore, in S322, the controller 80 refers to the RAM 80*c* and checks the data of the instruction.

If it is desired to adjust image data directly dependently on the paper density (yes in S322), the program proceeds to S324, in which the controller 80 controls the paper sensor 82 to detect the density of the paper 5. The paper sensor 62 detects density of the paper 5 for cyan, magenta, yellow, and black components, and produces a set of paper density data (Pc, Pm, Py, Pk), wherein Pc, Pm, Py, Pk indicate density of paper 5 for the cyan, magenta, yellow, and black components in the range of 0 to 255. The controller 80 receives the set of paper density data (Pc, Pm, Py, Pk) from the paper sensor 82.

Next, in S326, the controller 80 executes a process of adjusting image data dependently on the density of paper 5.

The process of S326 will be described below in greater detail with reference to FIG. 9(*b*).

First, in S3262, the controller 80 adds a set of paper density data (Pc, Pm, Py, Pk) to a set of pixel data (C, M, Y, K) for each pixel in the image data into an adjusted set of pixel data (C', M', Y', K'), wherein C'=C+Pc, M'=M+Pm, Y'=Y+Py, and K'=K+Pk.

In this way, the density characteristics of the image data are darkened by an amount that corresponds to the paper density. Hence, as the paper density becomes darker, the adjusted density of the image data becomes darker, and as the paper density becomes lighter, the adjusted density of the image data becomes lighter.

Next, in S3264, the controller 80 adjusts each of the resultant values C', M', Y', K' into the range of 0 to 255 so that the adjusted pixel data set (C', M', Y', K') becomes a set of appropriate values.

Then, the program returns to S170 (FIG. 9(*a*)), in which the controller 60 controls the sheet supply unit 7 and the image forming unit 9 to perform the above-described operations (1)-(5) repeatedly the required pages' number of times, while setting the pulse width of the laser beam; the amount of the voltage applied to the developing rollers 37; and the amount of charges applied from the photosensitive belt charger 45 based on the adjusted density levels C', M', Y', and K'.

On the other hand, if it is not desired to adjust image data directly dependently on paper density (no in S322), then the program proceeds to the patch data selecting process of S130'.

Details of the process S130' will be described with reference to FIG. 9(*c*).

The process of S130' is different from the process of S130 (FIG. 3(*b*)) in the first embodiment in that processes of S360-S380 are added after the processes of S240 and S250. That is, after patch densities are set for all the toner colors in the processes of S220-S240 or in the process of S250, the program proceeds to S360.

In S360, the controller 80 judges whether or not to consider density of the paper 5 when setting patch densities. It is noted that before the printing process of FIG. 9(*a*) is started being executed, the user has already manipulated the control panel 92 or the host computer 90 to input his/her instruction indicating whether or not to consider density of the paper 5 when setting patch densities. Data of the inputted instruction is stored in the RAM 80*c*. Therefore, in S360, the controller 80 refers to the RAM 80*c* and checks the data of the instruction.

If it is unnecessary to consider density of the paper 5 when setting patch densities (no in S360), the program proceeds to S140 (FIG. 9(*a*)) without adjusting the patch densities dependently on the paper density.

On the other hand, if it is necessary to consider density of the paper 5 when setting patch densities (yes in S360), the program proceeds to S370, in which the controller 80 acquires density of the paper 5, that is, a set of paper density data (Pc, Pm, Py, Pk) by controlling the paper sensor 82 to detect density of the paper 5 in the same manner as in S324 (FIG. 9(*a*)).

Next, in S380, the controller 80 adjusts densities in the patch density groups, which have been selected in S220-S240 or in S250, based on the paper density data set (Pc, Pm, Py, Pk).

Following are details of the processes executed by the controller 80 in S380 for cyan color component. It is noted that the controller 80 executes the same process in S380 for each of the other remaining color components.

The controller 80 first refers to the paper-to-rate table T4 shown in FIG. 10(*a*). The controller 80 determines in which paper density range the cyan color component Pc of the paper density data set (Pc, Pm, Py, Pk) falls, and sets an adjustment rate to a value that corresponds to the determined paper density range. If the density level Pc is 60, for example, the controller 80 determines that the density level Pc falls in the range of 32-63, and sets the adjustment rate to a value of 5%.

The controller 80 then shifts, by the adjustment rate, the density values in the patch density group, which have been selected in S220-S240 or in S250 for cyan component. For example, if the patch density group A (10%, 15%, 20%, 25%, 30%) shown in FIG. 6(*b*) has been set for the cyan component, 5% is added to all density values in the patch density group, thereby being shifted into the patch densities (15%, 20%, 25%, 30%, 35%) as shown in FIG. 10(*b*). Similarly, if the patch density group B, C, D, E, or F has been set for the cyan component, 5% is added to all density values in the subject patch density group as also shown in FIG. 10(*b*).

The above-described shifting process is performed for all toner colors, and the shifted patch densities are set as the final patch densities. Then, the process of S380 is ended, and the program proceeds to S140. Then, the processes of S140-S170 are executed in the same manner as in the first embodiment by using the adjusted patch densities.

In the present embodiment, image data is adjusted in S326 dependently on paper density. More specifically, the density characteristics of the image data are adjusted to be darkened by an amount that corresponds to the paper density. As the paper density becomes darker, the adjusted density of the image data becomes darker. As the paper density becomes lighter, the adjusted density of the image data becomes lighter. Similarly, patch densities are adjusted in S380 dependently on the paper density so that the patch densities are adjusted to be darkened by an amount that corresponds to the paper density. As the paper density becomes darker, the adjusted patch densities become darker. As the paper density becomes lighter, the adjusted patch densities become lighter. A highly precise correction table CT can be obtained by using the measurement patches with their densities reflecting the density characteristics of the paper density.

In this way, in the second embodiment, the overall image data is adjusted darker when the paper density is dark. Therefore, "paper density" indirectly indicates the density level within the predetermined part of the image. Accordingly, the paper density is considered as indirectly indicating the density level in the predetermined part of the image, and therefore patch densities are adjusted dependently on the paper density.

In the present embodiment, density characteristics of the image data are adjusted so that as the paper density becomes darker, the adjusted density of the image data becomes darker and so that as the paper density becomes lighter, the adjusted density of the image data becomes lighter. Accordingly, the printer 1 can perform printing suitable for the density of the paper. Moreover, the printer 1 can select suitable measurement patches that account for such adjustments in image density.

It is noted that the process of FIG. 9(*c*) may be modified to automatically advance from S240 or S250 to S370 by omitting S360.

As described above, according to the first and second embodiments, the printer 1 is capable of generating a plurality of different measurement patch groups, each group being configured of a plurality of measurement patches having different densities. According to the first embodiment, by examining image data, the printer 1 determines an overall density level of a predetermined part in the image desired to be formed. According to the second embodiment, the printer 1 determines the overall density level of the predetermined part in the desired image by examining both the image data and paper density because the printer 1 adjusts image data based on the paper density. Based on the determined overall density level of the predetermined part in the desired image, the printer 1 determines patch densities for the measurement patches so that the patch densities will become darker as the overall density level becomes darker and will become lighter as the overall density level becomes lighter. When the measurement patches are generated based on the determined patch densities, the density sensor 71 is controlled to measure the densities in the measurement patches. The correction table CT is created based on the measured results. The printer 1 corrects densities in the image data based on the correction table CT, and prints the image on the paper 5 based on the corrected image data.

As a comparative example, it is assumed that a printer can generate only one predetermined measurement patch group. This comparative printer prints the only one measurement patch group regardless of whether or not the densities of the measurement patches are optimal for an image desired to be formed. For example, the comparative printer uses a single measurement patch group for all types of images, such as relatively dark images having overall dark densities and relatively light images having overall light densities. The comparative printer will be unable to create highly accurate correction table.

Contrarily, according to the first embodiment, when image data has relatively dark density characteristics, a measurement patch group having a large number of relatively dark measurement patches are used. When the image data has relatively light density characteristics, another measurement patch group that has a large number of relatively light measurement patches are used. By thus using the measurement patch group suitable for the image to be formed, it is possible to create a correction table CT that is suitable for the subject image data.

According to the second embodiment, density levels of image data are adjusted or shifted dependently on paper density. Accordingly, patch densities are adjusted also dependently on paper density. For example, when printing image data on a relatively dark paper, image data is shifted darker by a relatively large amount. In this case, patch densities are shifted also darker by a relatively large amount so that a resultant measurement patch group has an increased number of dark measurement patches. It is possible to create a correction table CT that is suitable for the paper being used.

Next will be described various modifications of the second embodiment.

<First Modification>

In the second embodiment, the image-data-density adjustment process of S3262 and the patch data adjusting process of S380 may be modified as described below.

In S3262, the controller 80 may judge whether or not color of paper 5, defined by the paper density data set (Pc, Pm, Py, Pk), is the same as or similar to either one of the toner colors of cyan, magenta, yellow, and black. Based on the judged result, addition of the paper density level to image data (C, M, Y, K) is executed only in the one color component, which the color of paper 5 is the same as or similar to.

For example, if color of paper 5 is the same as or similar to cyan, the cyan component of the paper density is added to the cyan density level C in the image data (C, M, Y, K), but other components of the paper density are not added to the corresponding density levels in the image data (C, M, Y, K).

In this case, in S380, the controller 80 may judge whether or not color of paper 5 defined by the paper density data set (Pc, Pm, Py, Pk) is the same as or similar to either cyan, magenta, yellow, or black. Based on the judged result, patch densities for only one toner color, which the color of paper 5 is the same as or similar to, are adjusted dependently on the paper density. For example, if color of paper 5 is the same as or similar to cyan, the patch densities for cyan are adjusted with an adjustment rate that is stored in the paper-to-rate table T4 (FIG. 10(*a*)) in correspondence with the cyan density of the paper 5, but patch densities for other colors are not adjusted.

<Second Modification>

Steps S220-S240 may be omitted from the patch data selecting process of S130' in FIG. 9(*c*).

In this modification, a predetermined single patch density group is prepared in advance and is stored in the ROM 80*b*. In S380, densities in the predetermined patch density group are shifted based on paper density.

For example, it is assumed that the predetermined patch density group has densities of 20%, 30%, 40%, 50%, and 60%. In this case, in S380, the densities of 20%, 30%, 40%, 50%, and 60% are added with an adjustment rate that is stored in the paper-to-rate table T4 (FIG. 10(*b*)) in correspondence with the paper density.

In this modification, the patch densities are determined based only on the density characteristics of the paper 5. It is noted that the density characteristics of the paper 5 can indicate the image-density characteristics of an image after the image is adjusted dependently on the paper density. Accordingly, by generating measurement patches to have densities that are determined dependently on the paper density characteristics and by measuring densities of the measurement patches, it is possible to create the correction table CT that will properly correct image data.

In this way, according to the first embodiment, patch densities are determined based on the density characteristics of the image data indicative of an image desired to be formed. According to the second embodiment, patch densities are determined based on both the density characteristics of the image data and the density characteristics of the paper. According to this modification, patch densities are determined based on the density characteristics of the paper. In each case, patch densities can indicate the image-density characteristics of the image desired to be formed on the paper 5. Accordingly, when measurement patches are generated to have the thus determined patch densities and when the correction table CT is created based on the measurement results of the measurement patches, the correction table CT will properly correct image data.

Next will be described other various modifications of the first and second embodiments.

In the first and second embodiments, overall density characteristics of the image are determined by examining the image data. However, the controller 80 may acquire data indicative of the overall density characteristics of the image from user input. For example, the user may input data indicative of how density levels of pixels in the predetermined part of the image are distributed in the density ranges I-IV for each color component using the control panel 92 or the external host computer 90. Patch densities are determined based on the inputted data, thereby generating appropriate measurement patches that reflect the density of the image.

In the second embodiment, the paper sensor 82 is used to acquire density data for the paper 5. However, the controller 80 may acquire the paper density data from user input. For example, the user may input data (Pc, Pm, Py, Pk) indicative of density of the paper 5 for each color component of cyan, magenta, yellow, and black using the control panel 92 or the external host computer 90. The controller 80 may adjust image data based on the inputted data. The controller 80 may adjust patch densities based on the inputted data. Patch densities are determined based on the inputted data, thereby generating appropriate measurement patches that reflect the density of the image.

In the first modification of the second embodiment, the paper sensor 82 is used to acquire information of color of the paper 5. However, the controller 80 may acquire paper color data from user input. For example, the user may input data indicative of color of the paper 5 using the control panel 92 or the external host computer 90.

While the invention has been described in detail with reference to the specific embodiments thereof, it would be apparent to those skilled in the art that various changes and modifications may be made therein without departing from the spirit of the invention.

For example, in the second embodiment, the controller 80 executes in S326 the process of adjusting image data dependently on the paper density in a manner as shown in FIG. 9(*b*). However, the controller 80 may adjust image data dependently on paper density in other various manners.

Figure 11:
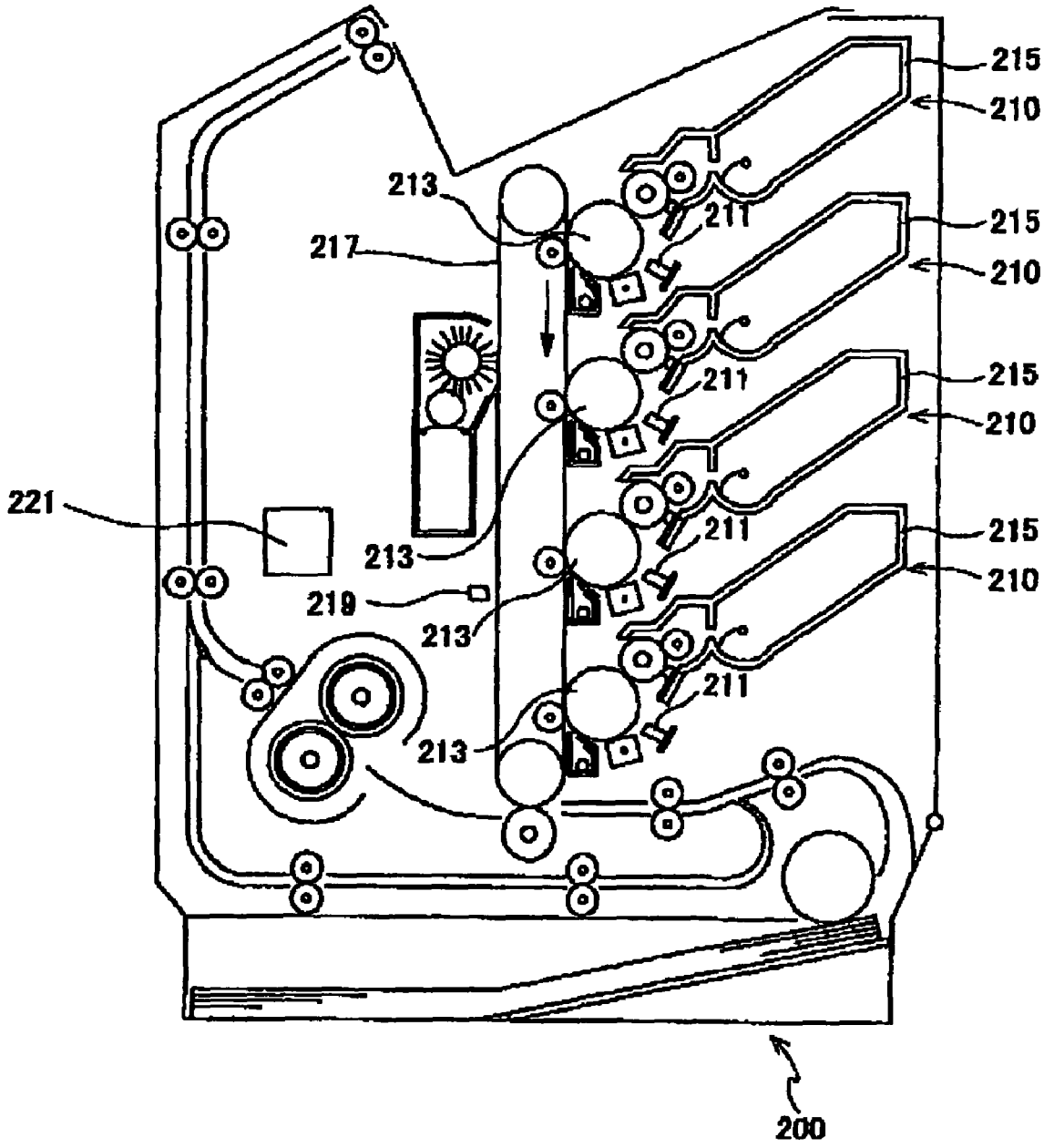
FIG. 11 is a cross-sectional view showing the general structure of a tandem color laser printer.

The four cycle color laser printer 1 can be modified into a tandem color laser printer 200 shown in FIG. 11. The color laser printer 200 includes: four processing units 210, an intermediate transfer belt (ITB) 217, a density detection sensor 219, and a controller 221.

The four processing units 210 are in one-to-one correspondence with the four colors cyan, magenta, yellow, and black. Each processing unit 210 includes: a scanner unit 211, a photosensitive drum 213, and a developer cartridge 215. Each processing unit 210 forms a toner image on the intermediate transfer belt 217. The processing units 210 form a full-color toner image on the intermediate transfer belt 217 within substantially only one revolution of the belt 217. The intermediate transfer belt 217 then transfers the toner image onto paper. The density detection sensor 219 includes: a light source for emitting light in the infrared range, a lens for directing the emitting light onto the intermediate transfer belt 217, and a phototransistor for detecting light reflected from the belt 217, thereby measuring the density of the toner image on the intermediate transfer belt 217.

The controller 221 controls the respective parts of the color laser printer 200, and executes the printing process of FIG. 3(*a*) and FIG. 3(*b*), FIG. 8, or FIG. 9(*a*)-FIG. 9(*c*). The processing units 210 form measurement patches on the intermediate transfer belt 217, and the density detection sensor 219 measures the density of the measurement patches formed on the intermediate transfer belt 217. The controller 221 generates and stores the correction table CT. Therefore, the tandem color laser printer 200 has the same benefits as the four-cycle color laser printer 1.

Figure 12:
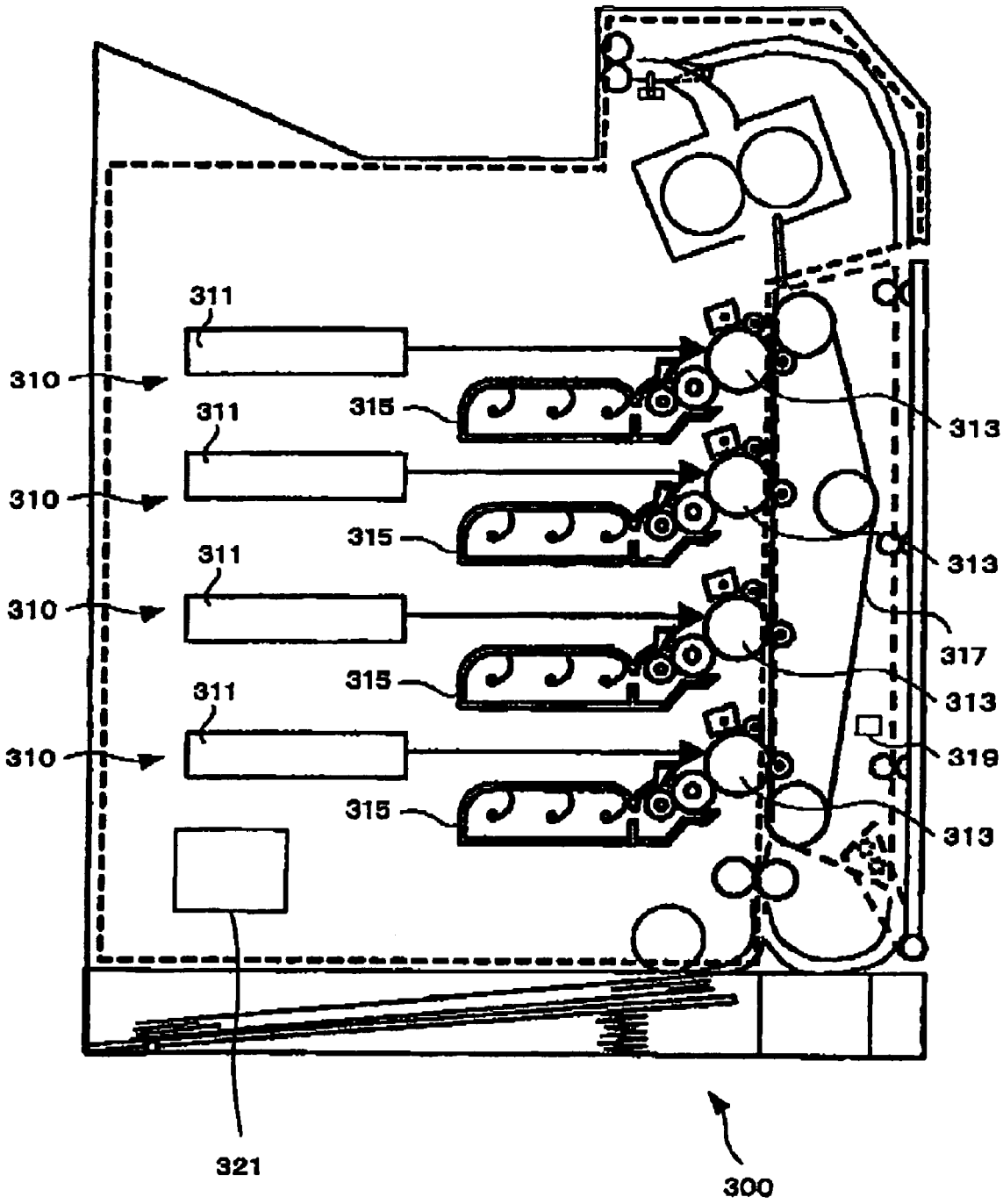
FIG. 12 is a cross-sectional view showing the general structure of a direct tandem color laser printer.

The four-cycle color laser printer 1 can be modified also into a direct tandem printer 300 shown in FIG. 12. The color laser printer 300 includes: four processing units 310, a transportation belt 317, a density detection sensor 319, and a controller 321. The four processing units 310 are in one-to-one correspondence with the four colors cyan, magenta, yellow, and black. Each processing unit 310 includes: a scanner unit 311, a photosensitive drum 313, and a developer cartridge 315. The processing units 310 form toner images directly on the paper. The transportation belt 317 conveys the paper, and the processing units 310 form the toner image as the paper is transported by the belt 317. The density detection sensor 319 has a light source for emitting light in the infrared range, a lens for directing the emitted light onto the transportation belt 317, and a phototransistor for detecting light reflected from the belt, thereby measuring the density of the toner images on the transportation belt is 317.

The controller 321 controls the respective parts of the color laser printer 300, and executes the printing process of FIG. 3(*a*) and FIG. 3(*b*), FIG. 8, or FIG. 9(*a*)-FIG. 9(*c*). During the patch creating process, the transportation belt 317 does not convey paper, but the processing units 310 form the measurement patches on the transportation belt 317, per se. Densities of the measurement patches formed on the transportation belt 317 are then measured by the density sensor 319. The controller 321 thus generates and stores the correction table CT. The direct tandem color laser printer 300 therefore has the same benefits as the four-cycle color laser printer 1.

In the above description, the color laser printers 1, 200, and 300 perform full-color printing by using toners of four colors (cyan, magenta, yellow, and black). However, a monochrome printer may also be used. The monochromatic printer prints images by using toner of a single color component. For the single color component, the image-density characteristics of an image are determined based on at least one of density data of the image and paper density data, and patch densities are determined based on the image-density characteristics of the image.

The color laser printers 1, 200, and 300 print images by using toners. However, a printer for printing images by using other various types of coloring agent can be used.

What is claimed is:

1. An image-forming device, comprising:

a printing unit that is capable of printing images;

an image-density characteristics determining unit that determines image-density characteristics of an image desired to be printed on a recording medium by the printing unit;

a patch density setting unit that dependent upon a result of the image-density characteristics determining unit sets patch density data based on the determined image-density characteristics of the desired image;

a patch generating unit that controls the printing unit, based on the patch density data set by the patch density setting unit, to generate a plurality of measurement patches;

a density measuring unit that measures densities of the measurement patches generated by the patch generating unit;

a correcting unit that performs density correction on image data indicative of the desired image according to the densities of the measurement patches measured by the density measuring unit; and a print controlling unit that controls the printing unit to print the desired image on the recording medium based on the image data corrected by the correcting unit.

2. The image-forming device according to claim 1, wherein the image-density characteristics determining unit determines a density level of a predetermined part in the desired image as the image-density characteristics of the desired image, and the patch density setting unit sets the patch density data dependently on the determined density level.

3. The image-forming device according to claim 1, further comprising:

a medium-density data acquiring unit that acquires medium-density data indicative of density of the recording medium; and an adjusting unit that adjusts the image data to adjust the density of the desired image based on the medium-density data acquired by the medium-density data acquiring unit;

wherein the image-density characteristics determining unit determines the image-density characteristics of the image based on the medium-density data.

4. The image-forming device according to claim 3, wherein the adjusting unit adjusts the image data to adjust the density of the desired image dependently on the density of the recording medium, the adjusted density of the desired image becoming darker as the density of the recording medium becomes darker, the adjusted density of the desired image becoming lighter as the density of the recording medium becomes lighter; and the image-density characteristics determining unit sets the patch density data of the measurement patches based on the density of the recording medium, the set patch density data of the measurement patches becoming darker as the density of the recording medium becomes darker, the set patch density data of the measurement patches becoming lighter as the density of the recording medium becomes lighter.

5. The image-forming device according to claim 1, further comprising a receiving unit that receives the image data indicative of the desired image from a source external to the image-forming device;

wherein the print controlling unit controls the printing unit to print the desired image on the recording medium based on the image data corrected by the correcting unit; and the image-density characteristics determining unit determines the image-density characteristics of the desired image based on density data included in the image data.

6. The image-forming device according to claim 5, wherein the image data includes a plurality of sets of pixel data for a plurality of pixels in the desired image, each pixel data indicating density of the relevant pixel; and the image-density characteristics determining unit determines image-density characteristics of the image based on the pixel data included in the image data.

7. The image-forming device according to claim 6, wherein the image-density characteristics determining unit sorts at least a part of the plurality of pixels into several density ranges based on the pixel data for the at least a part of the plurality of pixels, thereby determining a density distribution of the at least a part of the plurality of pixels, and determines a density range, to which the largest number of pixels belong within the at least a part of the plurality of pixels; and the patch density setting unit sets the patch density data based on the density range to which the largest number of pixels belong.

8. The image-forming device according to claim 1, wherein the printing unit is capable of forming images using toner of a plurality of colors;

the image-density characteristics determining unit determines image-density characteristics of the desired image by determining the image-density characteristics for each color of the desired image;

the patch density setting unit sets the patch density data for each color based on the image-density characteristics of the desired image for the subject color, the patch generating unit controlling the printing unit to generate the measurement patches for each color based on the patch density data for each color.

9. The image-forming device according to claim 8, wherein the patch generating unit judges, for each color, whether or not the results of determination by the image-density characteristics determining unit meet a predetermined condition, the patch generating unit controlling the printing unit to generate measurement patches for a color, for which the results of determination by the image-density characteristics determining unit meet the predetermined condition, the patch generating unit failing to control the printing unit to generate measurement patches for another color, for which the predetermined condition is not met.

10. The image-forming device according to claim 9, further comprising a storing unit that stores, for each color, image-density characteristics of another image that has been used for generating measurement patches previously; and a change confirming unit that confirms changes between the image-density characteristics of the desired image for each color and the image-density characteristics of the other image for the subject color;

wherein the patch generating unit determines, for each color, whether changes between the image-density characteristics of the desired image and the image-density characteristics of the other image meet a specific change condition, and controls the printing unit to generate measurement patches for a color, to which the specific change condition is met and fails to control the printing unit to generate measurement patches for another color, to which the specific change condition is not met.

11. The image-forming device according to claim 1, wherein the patch generating unit controls the printing unit to generate the measurement patches when the results of determination by the image-density characteristics determining unit meet a predetermined condition and fails to generate the measurement patches when the predetermined condition is not met.

12. The image-forming device according to claim 11, further comprising a storing unit that stores image-density characteristics of another image that has been used for generating measurement patches previously; and a change confirming unit that confirms changes-between the image-density characteristics of the desired image and the image-density characteristics of the other image;

wherein the patch generating unit determines whether changes between the image-density characteristics of the desired image and the image-density characteristics of the other image meet a specific change condition, and controls the printing unit to generate measurement patches when the specific change condition is met and fails to control the printing unit to generate measurement patches when the specific change condition is not met.

13. The image-forming device according to claim 1, further comprising:

an input unit enabling a user to input settings data, wherein the image-density characteristics determining unit determines the image-density characteristics of the desired image based on the inputted settings data, wherein the user inputs medium-density data as the settings data on the inputting unit, the medium-density data indicating density of the recording medium, and wherein the patch density setting unit sets the patch density data of the measurement patches based on the inputted medium-density data.

14. The image-forming device according to claim 13, wherein the printing unit forms images using toner of a plurality of colors;

the user inputs on the inputting unit the settings data corresponding to each toner color;

the patch density setting unit sets the patch density data of the measurement patches for each toner color based on the settings data; and the patch generating unit controls the printing unit to generate the measurement patches for each toner color.

15. The image-forming device according to claim 13, wherein the print unit prints the images by using a plurality of toner colors, and wherein the input unit enables the user to input the settings data for each of the plurality of toner colors independently from one another.

16. The image-forming device according to claim 1, further comprising:

an input unit enabling a user to input settings data, wherein the image-density characteristics determining unit determines the image-density characteristics of the desired image based on the inputted settings data, and wherein the user inputs image-density data as the settings data on the inputting unit, the image-density data indicating density of the desired image to be formed on the recording medium, and wherein the patch density setting unit sets the patch density data of the measurement patches based on the image-density data.

17. The image-forming device according to claim 16, wherein the printing unit forms images using toner of a plurality of colors, wherein the user inputs on the inputting unit the settings data corresponding to each toner color, wherein the patch density setting unit sets the patch density data of the measurement patches for each toner color based on the settings data, and wherein the patch generating unit controls the printing unit to generate the measurement patches for each toner color.

18. The image-forming device according to claim 16, wherein the print unit prints the images by using a plurality of toner colors, and wherein the input unit enables the user to input the settings data for each of the plurality of other colors independently from one another.

19. An image-forming device, comprising:

a printing unit that is capable of printing images on a recording medium;

a medium-density acquiring unit that acquires medium-density data indicative of density of the recording medium;

an adjusting unit that is capable of adjusting image data indicative of density of an image based on the medium-density data;

a patch density setting unit that sets patch density data based on the medium-density data;

a patch generating unit that controls the printing unit to generate a plurality of measurement patches based on the patch density data set by the patch density setting unit;

a density measuring unit that measures the densities of the measurement patches generated by the patch generating unit;

a correcting unit that performs density correction of image data indicative of an image desired to be printed on the recording medium according to the densities of the measurement patches measured by the density measuring unit; and a print controlling unit that controls the printing unit to print the desired image on the recording medium based on the image data corrected by the correcting unit.

20. The image-forming device according to claim 19, wherein the adjusting unit is capable of adjusting the image data of an image dependently on density of the recording medium indicated by the medium-density data, the adjusted image data becoming darker as the density of the recording medium becomes darker, the adjusted image data becoming lighter as the density of the recording medium becomes lighter; and the patch density setting unit sets the patch density data of the measurement patches based on the density of the recording medium indicated by the medium-density data, the set patch density data of the measurement patches becoming darker as the density of the recording medium becomes darker, the set patch density data of the measurement patches becoming lighter as the density of the recording medium becomes lighter.

21. The image-forming device according to claim 19, wherein the printing unit is capable of forming images using toner of a plurality of colors, the medium-density acquiring unit acquires medium-density data indicative of density of the recording medium for each color, the adjusting unit is capable of adjusting for each color, the image data based on the medium-density data, the patch density setting unit sets, for each color, patch density data based on the medium-density data, the patch generating unit controls the printing unit to generate, for each color, a plurality of measurement patches based on the patch density data set by the patch density setting unit for the each color, the density measuring unit measures, for each color, densities of the measurement patches generated by the patch generating unit, the correcting unit performs, for each color, density correction of the image data indicative of the image desired to be printed on the recording medium according to the densities of the measurement patches measured by the density measuring unit, and the print controlling unit controls the printing unit to print the desired image using toner of the plurality of colors on the recording medium based on the image data corrected by the correcting unit.

22. An image-forming device, comprising:

a printing unit that is capable of printing images on a recording medium;

an image-data receiving unit that receives an image that includes image data indicative of density of an image desired to be formed on the recording medium;

a patch density determining unit that determines one patch density group dependently on at least one of the image data and density of the recording medium, the one patch density group including several patch densities;

a patch generating unit that controls the printing unit to generate a group of measurement patches based on the determined patch density group, the group of measurement patches including several measurement patches, the several measurement patches being generated based on the several patch densities included in the determined patch density group;

a density measuring unit that measures densities of the several measurement patches generated by the patch generating unit;

a correction data generating unit that generates correction data based on the measured densities;

a correction-data-dependent image-data correcting unit that corrects the image data based on the correction data; and a print controlling unit that controls the printing unit to print the desired image on the recording medium based on the image data corrected by the correction-data-dependent image-data correcting unit.

23. The image-forming device as claimed in claim 22, wherein the patch density determining unit includes:

a patch density data storing unit that is prestored with a plurality of different groups of patch densities, each patch density group including several patch densities different from one another; and a patch density selecting unit that selects one patch density group dependently on at least one of the image data and the density of the recording medium, and wherein the patch generating unit controls the printing unit to generate the group of measurement patches based on the selected patch density group.

24. The image-forming device as claimed in claim 22, further comprising a patch-generation judging unit that judges whether or not the patch density group determined by the patch density determining unit meets a predetermined condition, wherein the patch generating unit controls the printing unit to generate the group of measurement patches when the determined patch density group meets the predetermined condition, the patch generating unit failing to control the printing unit to generate the group of measurement patches when the determined patch density group fails to meet the predetermined condition.

25. The image-forming device as claimed in claim 24, further comprising a data-storing unit that stores the correction data that is generated by the correction-data generating unit and that stores data of the patch density group that has been used to generate the correction data, wherein the patch-generation judging unit judges whether or not a new patch density group newly determined by the patch density determining unit is the same as a previous patch density group that has been determined latest by the patch density determining unit and that is now being stored in the patch-density-group storing unit, and wherein the patch generating unit controls the printing unit to generate the group of measurement patches based on the new patch density group when the new patch density group is different from the previous patch density group, the patch generating unit failing to control the printing unit to generate the group of measurement patches when the new patch density group is the same as the previous patch density group.

26. The image-forming device as claimed in claim 22, further comprising:

a medium-dependent image-data adjusting unit that adjusts the image data dependently on the density of the recording medium; and a selecting unit that selects either one of the correction-data-dependent image-data correcting unit and the medium-dependent image-data adjusting unit, wherein when the selecting unit selects the correction-data-dependent image-data correcting unit, the print controlling unit controls the printing unit to print the desired image on the recording medium based on the image data corrected by the correction-data-dependent image-data correcting unit, and wherein when the selecting unit selects the medium-dependent image-data adjusting unit, the print controlling unit controls the printing unit to print the desired image on the recording medium based on the image data adjusted by the medium-dependent image-data adjusting unit.

27. The image-forming device as claimed in claim 22, wherein the printing unit includes:

an intermediate recording portion; and an image-forming unit that is capable of forming images on the recording medium, the image-forming unit being capable of forming images also on the intermediate recording portion, wherein the patch generating unit controls the printing unit to form the group of measurement patches onto the intermediate recording portion, and wherein the density measuring unit measures the densities of the several measurement patches formed on the intermediate recording portion.

28. The image-forming device as claimed in claim 22, wherein the printing unit includes:

an intermediate recording medium;

an image-forming unit that is capable of forming images on the intermediate recording portion; and a transferring unit that transfers the images from the intermediate recording medium onto the recording medium, wherein the print controlling unit controls the image-forming unit, based on the corrected image data, to form the desired image on the intermediate recording medium, wherein the print controlling unit controls the transferring unit to transfer the desired image from the intermediate recording medium onto the recording medium, wherein the patch generating unit controls the printing unit to form the group of measurement patches onto the intermediate recording medium, and wherein the density measuring unit measures the densities of the several measurement patches formed on the intermediate recording medium.

* * * * *